US009499296B2

(12) United States Patent
Mills et al.

(10) Patent No.: US 9,499,296 B2
(45) Date of Patent: Nov. 22, 2016

(54) CARTON FOR A FOOD PRODUCT

(71) Applicant: GRAPHIC PACKAGING INTERNATIONAL, INC., Atlanta, GA (US)

(72) Inventors: Karen L. Mills, Limerick, PA (US); Mark P. Baker, Ft. Wayne, IN (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/339,741

(22) Filed: Jul. 24, 2014

(65) Prior Publication Data

US 2015/0028088 A1 Jan. 29, 2015

Related U.S. Application Data

(60) Provisional application No. 61/958,323, filed on Jul. 25, 2013.

(51) Int. Cl.

| | |
|---|---|
| ***B65D 5/72*** | (2006.01) |
| ***B31B 1/90*** | (2006.01) |
| ***B31B 1/26*** | (2006.01) |
| ***B31B 1/74*** | (2006.01) |
| ***B65D 5/42*** | (2006.01) |
| ***B65D 5/64*** | (2006.01) |
| ***A47G 21/00*** | (2006.01) |
| ***B65D 5/66*** | (2006.01) |
| ***B65D 5/02*** | (2006.01) |
| ***B65D 85/36*** | (2006.01) |

(52) U.S. Cl.

CPC ..... *B65D 5/725* (2013.01); *A47G 21/001* (2013.01); *B65D 5/029* (2013.01); *B65D 5/4295* (2013.01); *B65D 5/6697* (2013.01); *B65D 85/36* (2013.01)

(58) Field of Classification Search

USPC ..... 229/120.13, 902, 903, 904, 911; 493/121, 87

See application file for complete search history.

(56) References Cited

U.S. PATENT DOCUMENTS

| | | | |
|---|---|---|---|
| 662,969 | A | 12/1900 | Roth |
| 978,569 | A | 12/1910 | Elkin |
| 1,516,090 | A | 11/1924 | Gary et al. |
| 1,651,848 | A | 12/1927 | Stevens |
| 1,667,376 | A | 4/1928 | Fehrenkamp |
| 1,814,561 | A | 7/1931 | Krumm |
| 1,824,862 | A | 9/1931 | Young |
| 2,100,888 | A | 11/1937 | Vine |
| 2,107,946 | A | 2/1938 | Inman |
| 2,132,966 | A | 11/1938 | O'Brien |
| 2,312,595 | A | 3/1943 | Smith |

(Continued)

FOREIGN PATENT DOCUMENTS

| | | |
|---|---|---|
| CA | 2 586 472 | 5/2006 |
| DE | 75 23 198 | 11/1975 |

(Continued)

OTHER PUBLICATIONS

International Search Report and Written Opinion for PCT/US2014/047946 dated Nov. 12, 2014.

*Primary Examiner* — Christopher Demeree

(74) *Attorney, Agent, or Firm* — Womble Carlyle Sandridge & Rice, LLP

(57) ABSTRACT

A carton for containing a cooked food product. The carton comprises a plurality of panels that extend at least partially around an interior of the carton. The plurality of panels can comprise a bottom panel, a first side panel, and a second side panel. A lid is positionable to at least partially close a top of the carton. A plurality of vent features are in at least one panel of the plurality of panels for at least partially maintaining product attributes of the cooked food product contained in the carton by at least partially venting the carton.

39 Claims, 33 Drawing Sheets

(56) References Cited

U.S. PATENT DOCUMENTS

| | | | | |
|---|---|---|---|---|
| 2,345,000 | A | 3/1944 | Newsom | |
| 2,363,861 | A | 11/1944 | Goodyear | |
| 2,565,146 | A | 8/1951 | Okon | |
| 2,583,915 | A | 1/1952 | Whitley | |
| 2,804,252 | A | 8/1957 | Nute | |
| 2,844,294 | A | 7/1958 | Williams | |
| 2,955,733 | A | 10/1960 | Wilson | |
| 2,967,610 | A | 1/1961 | Ebert | |
| 3,107,039 | A | 10/1963 | Painter | |
| 3,142,430 | A | 7/1964 | Meyers | |
| 3,204,814 | A * | 9/1965 | Mahon | 206/162 |
| 3,240,419 | A | 3/1966 | Spiering et al. | |
| 3,324,998 | A | 6/1967 | Farquhar | |
| 3,515,331 | A | 6/1970 | Guthrie | |
| 3,637,130 | A | 1/1972 | Farquhar | |
| 3,809,310 | A * | 5/1974 | VanderLugt, Jr. | 229/110 |
| 3,876,131 | A | 4/1975 | Tolaas | |
| 3,907,195 | A | 9/1975 | Struble | |
| 4,008,849 | A | 2/1977 | Baber | |
| 4,039,120 | A | 8/1977 | Herzog | |
| 4,088,262 | A * | 5/1978 | Kuehlhorn | B65D 5/4608 206/194 |
| 4,105,155 | A | 8/1978 | Forbes, Jr. | |
| 4,228,945 | A | 10/1980 | Wysocki | |
| 4,313,542 | A | 2/1982 | Roberts et al. | |
| 4,477,014 | A | 10/1984 | Brandenburger | |
| 4,492,333 | A | 1/1985 | Roberts | |
| 4,530,459 | A | 7/1985 | Maroszek | |
| 4,592,914 | A | 6/1986 | Kuchenbecker | |
| 4,714,190 | A * | 12/1987 | Morrocco | 229/404 |
| 4,775,771 | A | 10/1988 | Pawlowski et al. | |
| 4,798,323 | A | 1/1989 | Platt | |
| 4,815,609 | A | 3/1989 | Kiedaisch | |
| 4,865,921 | A | 9/1989 | Hollenberg et al. | |
| 4,890,439 | A | 1/1990 | Smart | |
| 4,919,785 | A | 4/1990 | Willey et al. | |
| 4,936,935 | A | 6/1990 | Beckett | |
| 4,963,424 | A | 10/1990 | Beckett | |
| 4,993,625 | A | 2/1991 | Stease et al. | |
| 5,034,234 | A | 7/1991 | Andreas et al. | |
| 5,039,364 | A | 8/1991 | Beckett et al. | |
| 5,047,710 | A | 9/1991 | Mahoney | |
| 5,071,062 | A | 12/1991 | Bradley et al. | |
| 5,078,273 | A | 1/1992 | Kuchenbecker | |
| 5,093,364 | A | 3/1992 | Richards | |
| 5,096,723 | A | 3/1992 | Turpin | |
| 5,117,078 | A | 5/1992 | Beckett | |
| 5,118,033 | A | 6/1992 | Kula | |
| 5,175,404 | A | 12/1992 | Andreas et al. | |
| 5,213,902 | A | 5/1993 | Beckett | |
| 5,221,419 | A | 6/1993 | Beckett | |
| 5,260,537 | A | 11/1993 | Beckett | |
| 5,266,386 | A | 11/1993 | Beckett | |
| 5,266,763 | A | 11/1993 | Colombo | |
| 5,300,748 | A | 4/1994 | Colombo | |
| RE34,683 | E | 8/1994 | Maynard et al. | |
| 5,338,921 | A | 8/1994 | Maheux et al. | |
| 5,340,436 | A | 8/1994 | Beckett | |
| 5,354,973 | A | 10/1994 | Beckett | |
| 5,402,931 | A | 4/1995 | Gulliver et al. | |
| 5,410,135 | A | 4/1995 | Pollart et al. | |
| 5,424,517 | A | 6/1995 | Habeger, Jr. et al. | |
| 5,458,283 | A | 10/1995 | Southwell et al. | |
| 5,484,100 | A | 1/1996 | Rigby | |
| 5,503,324 | A | 4/1996 | Bacchetti et al. | |
| 5,510,132 | A | 4/1996 | Gallo, Jr. | |
| 5,519,195 | A | 5/1996 | Keefer et al. | |
| 5,542,536 | A * | 8/1996 | Sutherland | 206/427 |
| 5,582,345 | A | 12/1996 | Lankhuijzen | |
| 5,585,027 | A | 12/1996 | Young | |
| 5,628,921 | A | 5/1997 | Beckett | |
| 5,672,407 | A | 9/1997 | Beckett | |
| 5,688,427 | A | 11/1997 | Gallo, Jr. | |
| 5,704,483 | A | 1/1998 | Groh | |
| 5,707,004 | A | 1/1998 | Cai | |
| 5,726,426 | A | 3/1998 | Davis et al. | |
| 5,759,422 | A | 6/1998 | Schmelzer et al. | |
| 5,800,724 | A | 9/1998 | Habeger et al. | |
| 5,938,110 | A | 8/1999 | Bernstein | |
| 6,063,415 | A | 5/2000 | Walters | |
| 6,102,568 | A | 8/2000 | Davis | |
| 6,114,679 | A | 9/2000 | Lai | |
| 6,150,646 | A | 11/2000 | Lai et al. | |
| 6,204,492 | B1 | 3/2001 | Zeng et al. | |
| 6,251,451 | B1 | 6/2001 | Zeng | |
| 6,414,290 | B1 | 7/2002 | Cole et al. | |
| 6,433,322 | B2 | 8/2002 | Zeng et al. | |
| 6,440,050 | B1 | 8/2002 | Capparelli | |
| 6,455,827 | B2 | 9/2002 | Zeng | |
| 6,552,315 | B2 | 4/2003 | Zeng et al. | |
| 6,677,563 | B2 | 1/2004 | Lai | |
| 6,683,289 | B2 | 1/2004 | Whitmore et al. | |
| 6,695,202 | B2 | 2/2004 | Miess | |
| 6,717,121 | B2 | 4/2004 | Zeng et al. | |
| 6,744,028 | B2 | 6/2004 | Chisholm et al. | |
| 6,765,182 | B2 | 7/2004 | Cole et al. | |
| 6,866,189 | B2 | 3/2005 | Nelson | |
| 6,966,483 | B2 | 11/2005 | Manninen | |
| 7,019,271 | B2 | 3/2006 | Wnek et al. | |
| D532,690 | S | 11/2006 | Oliveira | |
| 7,159,760 | B2 | 1/2007 | Pluck et al. | |
| 7,323,699 | B2 | 1/2008 | Hopkins et al. | |
| 7,365,292 | B2 | 4/2008 | Cole et al. | |
| 7,414,230 | B2 | 8/2008 | Fitzwater | |
| 7,473,875 | B2 | 1/2009 | Fitzwater | |
| 7,514,659 | B2 | 4/2009 | Lafferty | |
| 7,617,969 | B2 | 11/2009 | Oliveira | |
| 7,621,439 | B2 | 11/2009 | McClure | |
| 7,652,233 | B2 | 1/2010 | Keefe | |
| 7,667,167 | B2 | 2/2010 | Fitzwater | |
| 7,893,389 | B2 | 2/2011 | Fitzwater | |
| 7,938,267 | B2 | 5/2011 | Cross | |
| 7,982,167 | B2 | 7/2011 | Fitzwater | |
| 8,309,896 | B2 | 11/2012 | Fitzwater | |
| 8,814,033 | B2 | 8/2014 | House | |
| 2003/0080120 | A1 | 5/2003 | Whitmore et al. | |
| 2003/0106926 | A1 | 6/2003 | Beatificato et al. | |
| 2003/0206997 | A1 | 11/2003 | Winkelman et al. | |
| 2004/0089656 | A1 | 5/2004 | Watkins | |
| 2004/0101605 | A1 | 5/2004 | Sigel | |
| 2004/0159698 | A1 | 8/2004 | Tallevi et al. | |
| 2005/0284865 | A1 | 12/2005 | Fogle et al. | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2006/0278521 | A1 | 12/2006 | Stowell | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0138247 | A1 | 6/2007 | Fitzwater | |
| 2007/0251942 | A1 | 11/2007 | Cole et al. | |
| 2007/0251943 | A1 | 11/2007 | Wnek et al. | |
| 2007/0275130 | A1 | 11/2007 | Cole et al. | |
| 2008/0000897 | A1 | 1/2008 | Robbins et al. | |
| 2008/0047958 | A1 | 2/2008 | Cole et al. | |
| 2008/0078759 | A1 | 4/2008 | Wnek et al. | |
| 2008/0081095 | A1 | 4/2008 | Cole et al. | |
| 2008/0179385 | A1 | 7/2008 | Nikolai et al. | |
| 2008/0290149 | A1 | 11/2008 | Sweet | |
| 2008/0308614 | A1 | 12/2008 | Fitzwater | |
| 2009/0039077 | A1 | 2/2009 | Fitzwater | |
| 2009/0090708 | A1 | 4/2009 | Requena et al. | |
| 2009/0200364 | A1 | 8/2009 | Oliveira | |
| 2010/0051675 | A1 | 3/2010 | Sweet | |
| 2010/0055260 | A1 | 3/2010 | Sweet | |
| 2010/0243510 | A1 | 9/2010 | Cross | |

FOREIGN PATENT DOCUMENTS

| | | |
|---|---|---|
| DE | 296 13 331 | 10/1996 |
| DE | 203 00 817 | 4/2003 |
| EP | 0 270 838 | 6/1988 |
| EP | 1 452 458 | 9/2004 |

(56) References Cited

FOREIGN PATENT DOCUMENTS

| | | |
|---|---|---|
| EP | 1 481 922 | 12/2004 |
| FR | 2 516 481 | 5/1983 |
| FR | 2 665 882 | 2/1992 |
| FR | 2 687 384 | 8/1993 |
| FR | 2 867 346 | 9/2005 |
| GB | 2 365 000 | 2/2002 |
| JP | 4-253670 | 9/1992 |
| JP | 03095906 | 6/2003 |
| JP | 2004 224402 | 8/2004 |
| JP | 03106317 | 10/2004 |
| JP | 2007-168832 | 7/2007 |
| JP | 2012-245989 A | 12/2012 |
| KR | 20-0253232 | 11/2001 |
| WO | WO 91/05448 | 4/1991 |
| WO | WO 94/05563 | 3/1994 |
| WO | WO 02/40374 | 5/2002 |
| WO | WO 03/066435 | 8/2003 |
| WO | WO 2005/077783 | 8/2005 |
| WO | WO 2005/085091 | 9/2005 |
| WO | WO 2006/052326 | 5/2006 |
| WO | WO 2006/076501 | 7/2006 |
| WO | WO 2007/067705 | 6/2007 |
| WO | WO 2007/127235 | 11/2007 |
| WO | WO 2007/133659 | 11/2007 |
| WO | WO 2007/136839 | 11/2007 |
| WO | WO 2008/137525 | 11/2008 |
| WO | WO 2008/137528 | 11/2008 |
| WO | WO 2009/023286 | 2/2009 |

* cited by examiner

CARTON FOR A FOOD PRODUCT

CROSS-REFERENCE TO RELATED APPLICATIONS

This application claims the benefit of U.S. Provisional Patent Application No. 61/958,323, filed Jul. 25, 2013.

INCORPORATION BY REFERENCE

The disclosure of U.S. Provisional Patent Application No. 61/958,323, which was filed on Jul. 25, 2013 is hereby incorporated by reference for all purposes as if presented herein in its entirety.

BACKGROUND OF THE DISCLOSURE

The present disclosure generally relates to cartons for holding and dispensing food products.

SUMMARY OF THE DISCLOSURE

In general, one aspect of the disclosure is directed to a carton for containing a cooked food product. The carton comprises a plurality of panels that extend at least partially around an interior of the carton. The plurality of panels can comprise a bottom panel, a first side panel, and a second side panel. A lid is positionable to at least partially close a top of the carton. A plurality of vent features are in at least one panel of the plurality of panels for at least partially maintaining product attributes of the cooked food product contained in the carton by at least partially venting the carton.

In another aspect, the disclosure is generally directed to a blank for forming a carton for containing a cooked food product. The blank comprises a plurality of panels comprising a bottom panel, a first side panel, and a second side panel. A lid is positionable to at least partially close a top of the carton formed from the blank. A plurality of vent features are in at least one panel of the plurality of panels for at least partially maintaining product attributes of the cooked food product contained in the carton formed by the blank by at least partially venting the carton formed from the blank.

In another aspect, the disclosure is generally directed to a method of forming a carton for containing a cooked food product. The method comprises obtaining a blank comprising a plurality of panels comprising a bottom panel, a first side panel, and a second side panel, a lid, and a plurality of vent features in at least one panel of the plurality of panels. The method further comprises forming an interior of the carton at least partially defined by the plurality of panels so that the lid is positionable to at least partially close a top of the carton. The vent features are for at least partially maintaining product attributes of the cooked food product contained in the carton by at least partially venting the carton.

Other aspects, features, and details of the present disclosure can be more completely understood by reference to the following detailed description of exemplary embodiments taken in conjunction with the drawings and from the appended claims.

Those skilled in the art will appreciate the above-stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons (e.g., carriers) with features for containing and facilitating dispensing articles such as food products, cooked food products, fried food products, hot and/or moist articles, etc. The articles can include, but are not limited to, fast food products, take-out products, meal leftovers, and the like, or any combination thereof. Examples of such products include, but are not limited to, fish, chicken, French fries, French toast sticks, sandwich, pizza, calzone, turnover, burrito, or any other food product that may be packaged for consumption by a consumer. In this specification, the terms "inner," "interior," "outer," "exterior," "lower," "bottom," "upper," and "top" indicate orientations determined in relation to fully erected and upright cartons.

Figure 1:
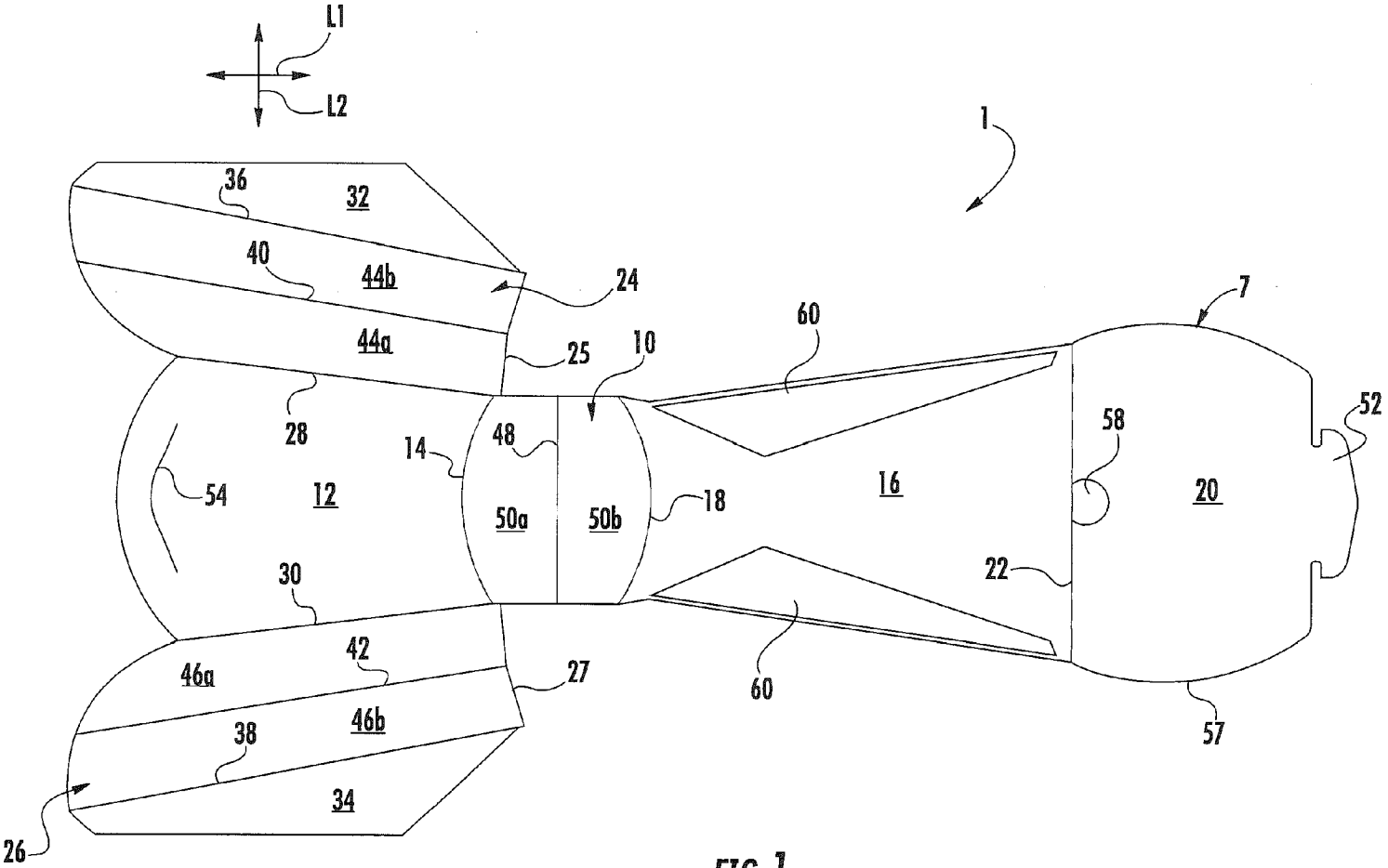
FIG. 1 is a plan view of a blank used to form a carrier according to a first embodiment of the disclosure.
Figure 2:
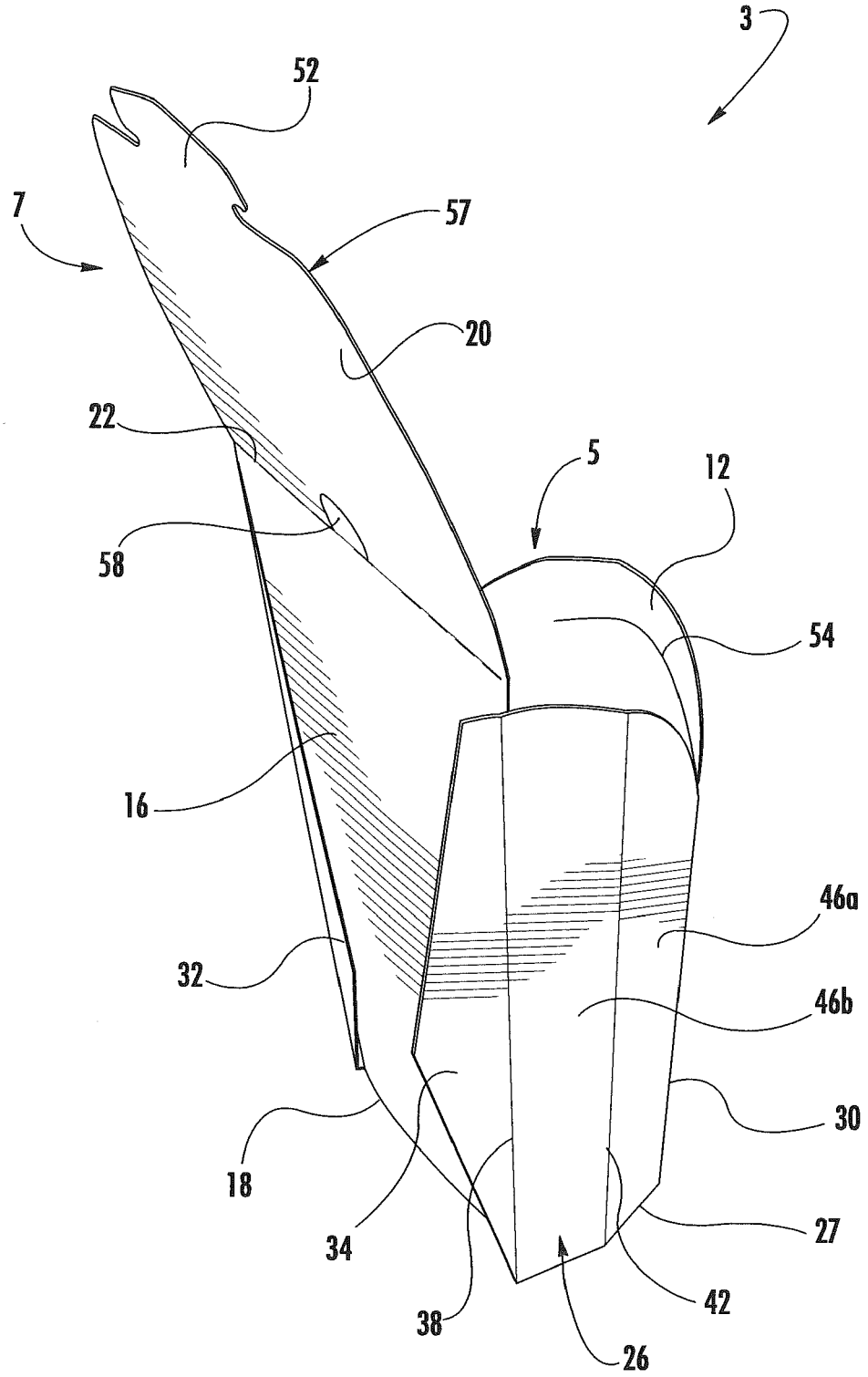
FIGS. 2 and 3 are perspective views showing the erected carrier with an open top.
Figure 3:
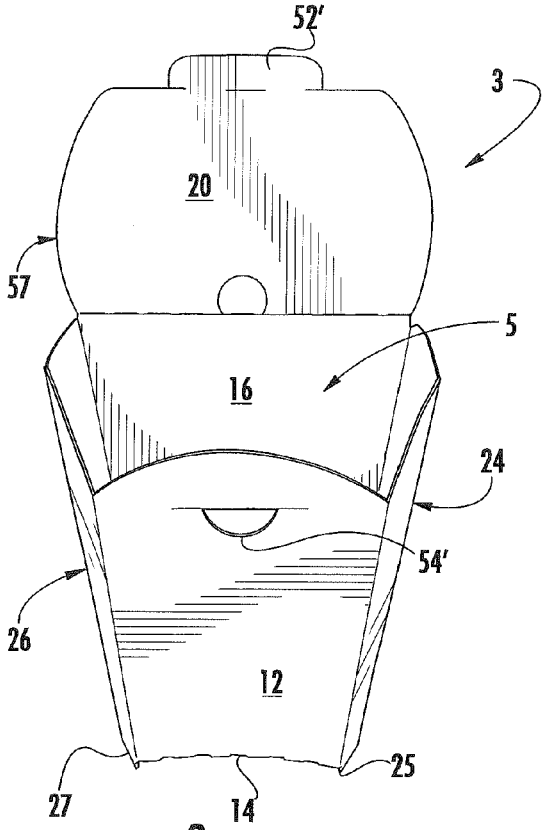
Figure 4:
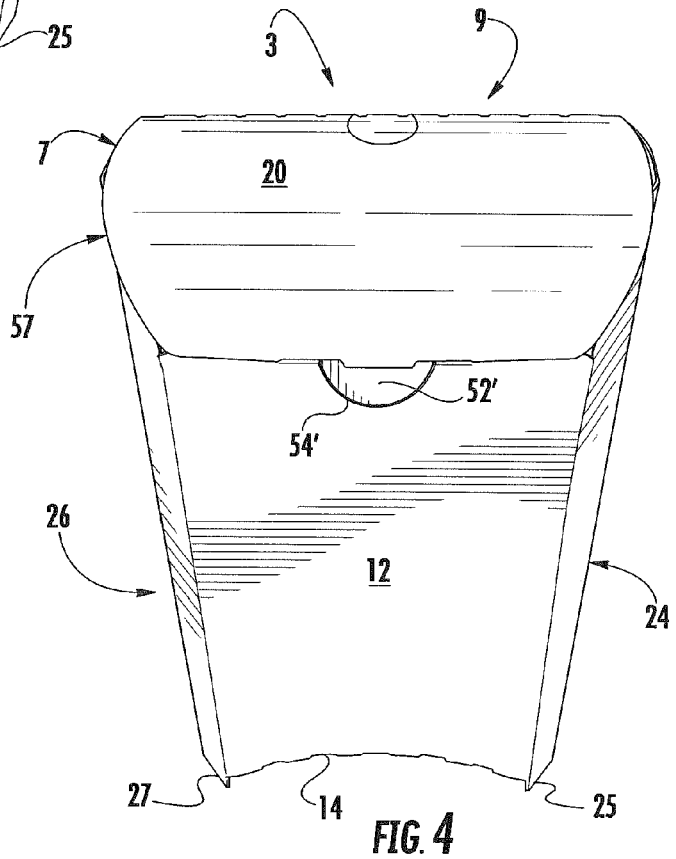
FIGS. 4-6 are perspective views showing the carrier of FIGS. 2 and 3 with a closed top.
Figure 5:
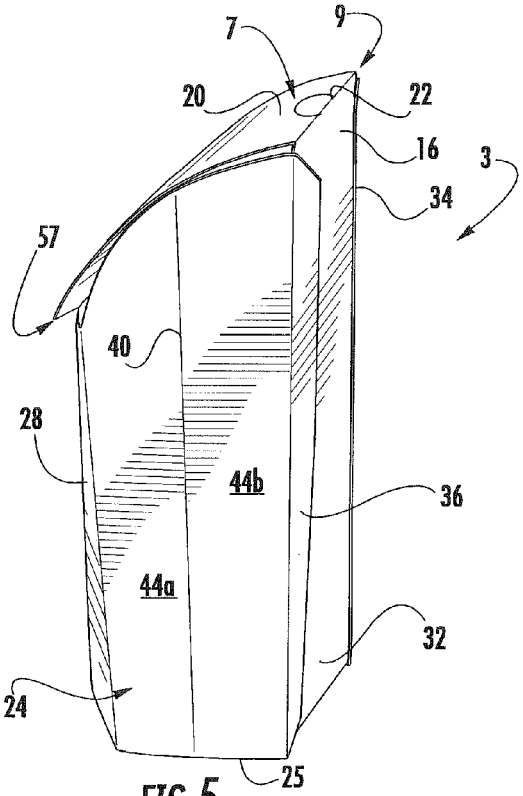
Figure 6:
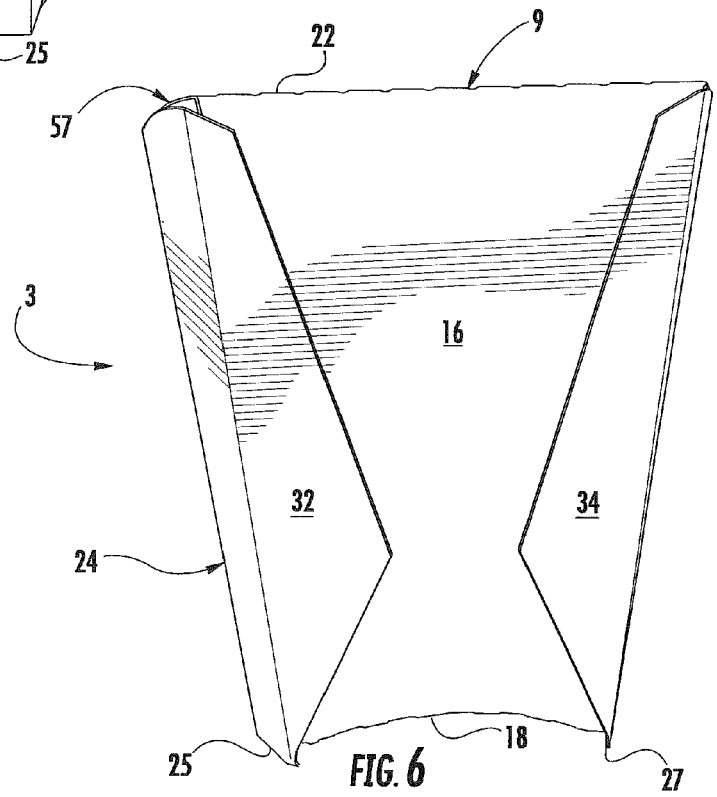
Figure 7:
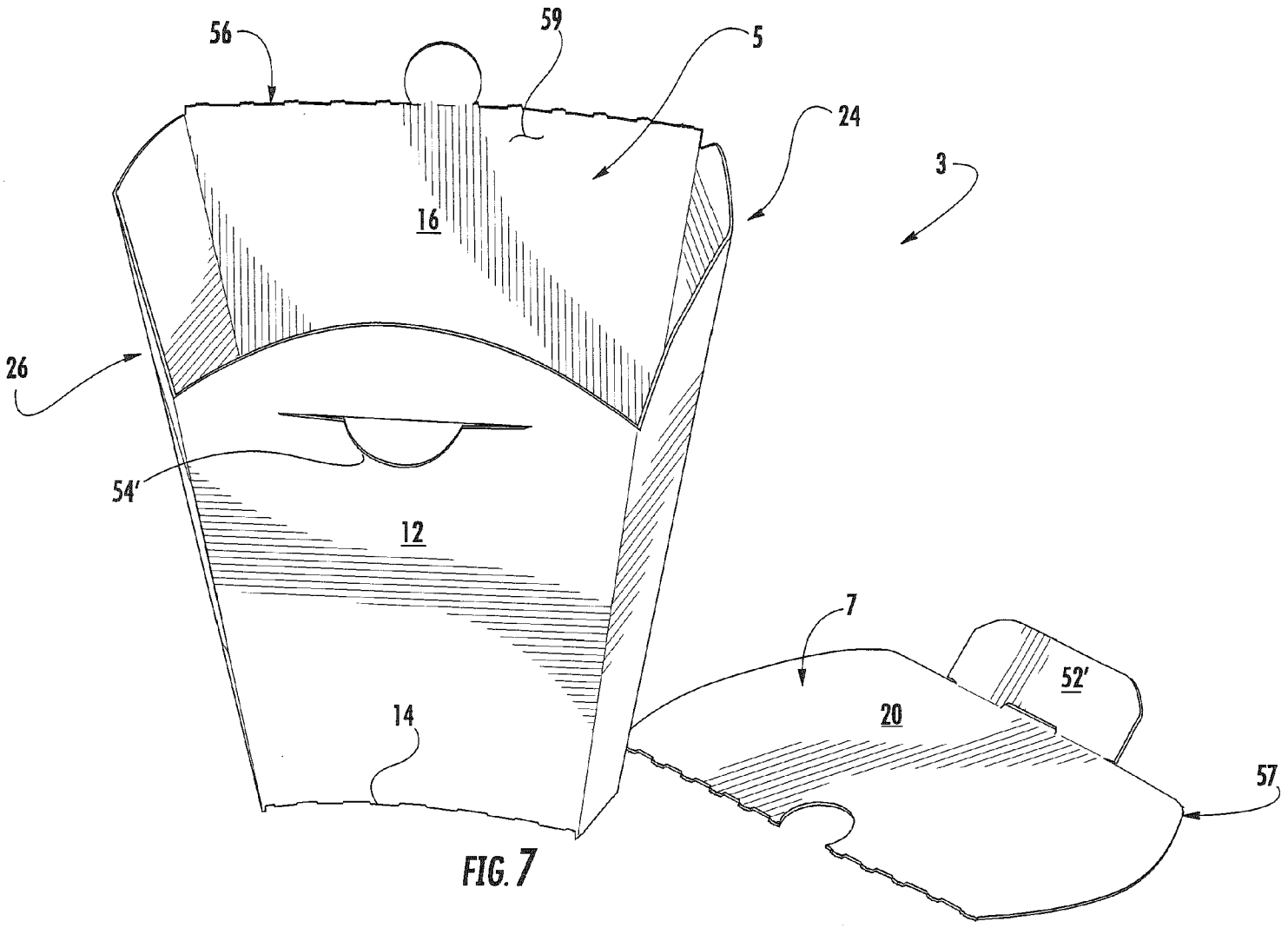
FIG. 7 is a perspective view of the carrier after a dispenser is actuated.

FIG. 1 is a plan view of a blank, generally indicated at 1, used to form a carton 3 (FIGS. 2-7) of a first embodiment of the disclosure. The carton 3 can be used to hold a food product (not shown) such as a fast food product (e.g., French fries) in an interior 5 of the carton (FIGS. 2, 3, and 7). In one embodiment, the carton 3 can be sized to fit in a hand and/or can be generally tapered (FIGS. 2-4). In one embodiment, the carton 3 can be used for holding, packaging, and/or serving cooked/fried food products from a fast food or quick service restaurant, but the carton could hold other types of food products or other non-food products without departing from the disclosure. In the illustrated embodiment, the carton 3 includes an integrated lid or cover, generally indicated at 7, and a dispenser, generally indicated at 9 (FIGS. 3-6).

In the illustrated embodiment, the blank 1 has a longitudinal axis L1 and a lateral axis L2. The blank 1 includes a bottom panel 10 foldably connected to a first side panel 12 at a first fold line 14, a second side panel 16 foldably connected to the bottom panel 10 at a second fold line 18, and a top panel 20 foldably connected to the second side panel 16 at a tear line 22. Alternatively, the top panel 20 could be foldably connected to the second side panel 16 or the first side panel 12 along a fold line or other line of weakening. A first end panel 24 and a second end panel 26 are respectively foldably connected to the first side panel 12 along respective fold lines 28, 30. Attachment flaps 32, 34 are foldably connected to the respective first end panel 24 and second end panel 26 along respective fold lines 36, 38. As shown in FIG. 1, the fold lines 14, 18 connecting the bottom panel 10 to the respective side panels 12, 16 are generally arcuate or crescent-shaped so that the bottom panel 10 is curved toward the interior 5 of the carton 3 (e.g., concave) when the carton 3 is formed (FIGS. 3, 4, and 6).

In the illustrated embodiment, the first and second end panels 24, 26 have respective fold lines 40, 42 that divide each of the end panels into respective end portions 44*a*, 44*b*, and 46*a*, 46*b*. Similarly, the bottom panel 10 includes a fold line 48 that divides the bottom panel into portions 50*a*, 50*b*. In the first embodiment, the end portions 44*a*, 44*b* of the end panel 24 are angled with respect to each other when the carton 3 is formed from the blank 1 such that the side panel 24 is generally non-planar (FIGS. 2-6). Similarly, the end portions 46*a*, 46*b* of the end panel 26 are angled with respect to each other in the assembled carton 3 such that the end panel 26 is generally non-planar. Additionally, the fold lines 40, 42, 48 can help the carton 3 to collapse to be generally flat for shipping when the end panels 24, 26 and the bottom panel 10 are folded along the respective fold lines 40, 42, 48 so that the end portions 44*a*, 46*a*, 50*a* are brought into face-to-face contact with the respective end portions 44*b*, 46*b*, 50*b*, and the first side panel 12 is brought into face-to-face contact with the second side panel 16. The blank 1 could have other end panel arrangements without departing from the disclosure. Additionally, the bottom panel 10, the side panels 12, 16, the top panel 20, the end panels 24, 26, and/or the attachment flaps 32, 34 could be otherwise shaped, arranged, positioned, and/or configured without departing from the disclosure.

In the illustrated embodiment, the lid 7 can include the top panel 20 and closure features (FIGS. 1 and 2) for helping to close the lid 7. The closure features can include a closure tab 52 (e.g., a first closure feature) extending from an edge of the top panel 20. The closure tab 52 can be configured to engage a closure slot 54 (e.g., a second closure feature comprising an arcuate cut line or another opening or receiving feature) in the first side panel 12. In the illustrated embodiment, the closure slit 54 is spaced apart from an upper edge of the first side panel 12. The lid 7 including the closure features, the top panel 20, and/or the first side panel 12 could be omitted or could be otherwise shaped, arranged, and/or configured without departing from the disclosure. For example, alternative closure features are shown in FIGS. 3, 4, and 7, wherein the closure tab 52' has a different shape than the closure tab 52, and the closure slot 54' includes a slit and an opening in communication with the slit.

Additionally, in the illustrated embodiment, the blank 1 can include dispensing features for forming the dispenser 9 (FIGS. 4-6) so that the carton 3 can be opened to form a serving vessel 56 (FIG. 7) for the food product in the carton 3. As shown in FIG. 1, the dispensing features include a dispenser panel 57, which comprises the top panel 20 in the first embodiment, and the tear line 22, which foldably connects the top panel 20 to the second side panel 16 in the first embodiment. In an alternative embodiment, the dispenser panel 57 could include at least a portion of any of the side and/or end panels of the blank 1 and/or could include less than the entire top panel 20. An access flap 58 can be included in the top panel 20 and/or the side panel 16 to help initiate tearing along the tear line 22 when removing the top panel 20 to access the food product in the interior 5 of the carton 3. The dispensing features could be otherwise shaped, arranged, and/or configured without departing from the disclosure. For example, the access flap 58 could be an access opening or other feature. In one embodiment, the access flap 58 can serve as a vent flap in the carton 3. Further, the dispensing features could include additional or alternative tear lines and/or tear strips for removing at least portions of the top panel 20, the side panels 12, 16, the end panels 24, 26, the attachment flaps 32, 34, and/or the bottom panel 10.

As shown in FIG. 2, the carton 3 can be at least partially formed from the blank 1 by folding along fold lines 14, 18 so that the side panels 12, 16 are generally opposed, and folding along fold lines 28, 30, 40, 42, 36, 38 so that the end flaps 24, 26 at least partially close the ends of the carton 3 and the attachment flaps 32, 34 are at least partially in face-to-face contact with the second side panel 16. In the illustrated embodiment, the attachment flaps 32, 34 can be glued to an exterior surface of the second side panel 16 (e.g., at glue areas 60). Alternatively, the attachment flaps could be glued or otherwise secured to the interior surface of the second side panel 16. In one embodiment, the carton 3 can be shipped to a restaurant or other food service location in a partially assembled and laid-flat condition, wherein the end panels 24, 26 are folded along the respective fold lines 40, 42 and the bottom panel 10 is folded along the fold line 48 so that the portions 44*a*, 46*a*, 50*a* are at least partially in face-to-face contact with the respective portions 44*b*, 46*b*, 50*b* and the side panels 12, 16 are at least partially in face-to-face contact with one another. Prior to placement of food product within the carton 3, the blank 1 can be formed into the carton 3 having an open top (FIGS. 2 and 3) by folding the end panels 24, 26 and the bottom panel 10 along the respective fold lines 40, 42, 48. The interior 5 of the carton 3 is at least partially enclosed by the side panels 12, 16, the end panels 24, 26, and the bottom panel 10. As shown in FIGS. 2-6, the bottom edges 25, 27 of the respective end panels 24, 26 are generally straight and horizontal so that the carton 3 can be generally free standing on a flat surface (e.g., the carton 3 can rest on the bottom edges 25, 27 of the end panels 24, 26). The carton 3 could be otherwise shaped, arranged, and/or configured without departing from the disclosure.

The carton 3 can be filled with a food product, such as by using a scoop (e.g., fry scoop, not shown) or other tools, or by using the open carton 3 as a scooper. The lid 7 can be closed by folding the top panel 20 along the tear line 22 and bending the top panel so that the top panel is curved and the closure tab 52 or 52' extends generally downwardly. The closure tab 52 or 52' can be inserted into the closure slot 54 or 54' from the interior side or the exterior side of the first side panel 12. The closed carton 3 with the closed integrated lid 7 is shown in FIGS. 4-6. Accordingly, the food product (e.g., cooked and/or fried potatoes or other products) can be protected and experience reduced product degradation relative to an open carton when transporting the carton 3 and the food product from a store or restaurant (e.g., a quick service restaurant or other stores or restaurants). For example, the closed carton 3 can help maintain product attributes (e.g., heat retention, crispness/crunch, texture—bite, break, just-cooked taste, and/or other features), product protection (e.g., product uniformity, reduced product breaking, reduced crushing, reduced loss of product by spilling, etc., and/or other attributes), and/or minimum product degradation (e.g., heat/moisture balance maintained so that the product is not soggy or limp and/or other features). Alternative loading and closing steps could be used without departing from the disclosure.

As shown in FIG. 7, the dispenser 9 can be actuated to open the closed carton 3 by tearing the dispenser panel 57 (including the top panel 20) away from the second side panel 16 along the tear line 22 and removing the closure tab 52 or 52' from the closure slot 54 or 54' to form a dispenser opening 59. Alternatively, the carton could be opened by removing the closure tab 52 from the closure slot 54 and folding the lid 7 upwardly along the tear line 22. The top panel 20 could then remain attached to the side panel 16 (e.g., FIGS. 2 and 3) or be torn away from the side panel 16. Accordingly, the carton 3 forms the serving vessel 56 where the food product in the interior 5 of the carton can be accessed through the open top of the carton 3. Accordingly, the dispenser 9 provides easy access to the food product at the dispenser opening 59. Other opening and serving steps could be used without departing from the disclosure.

Figure 8:
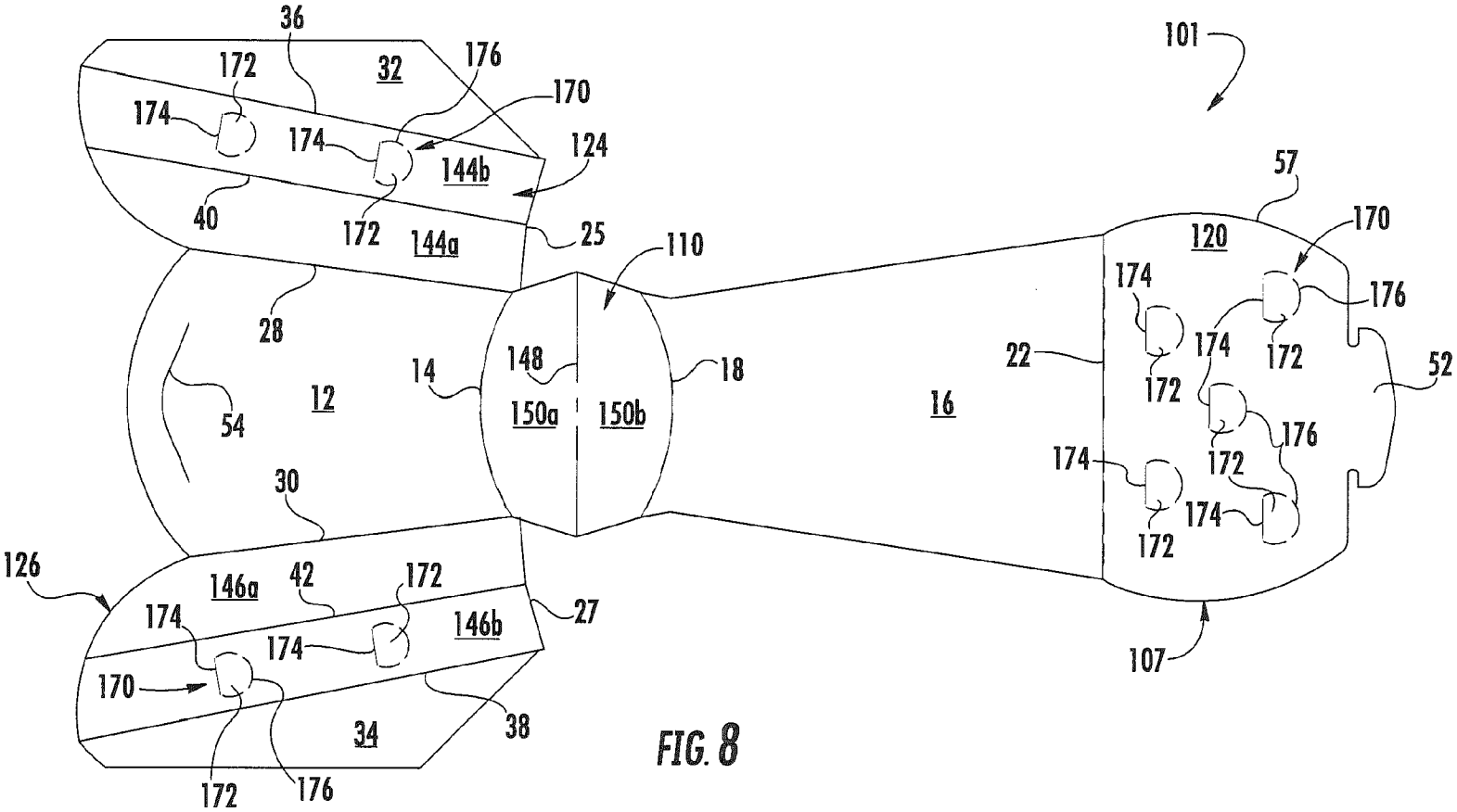
FIG. 8 is a plan view of a blank used to form a carrier according to a second embodiment of the disclosure.
Figure 9:
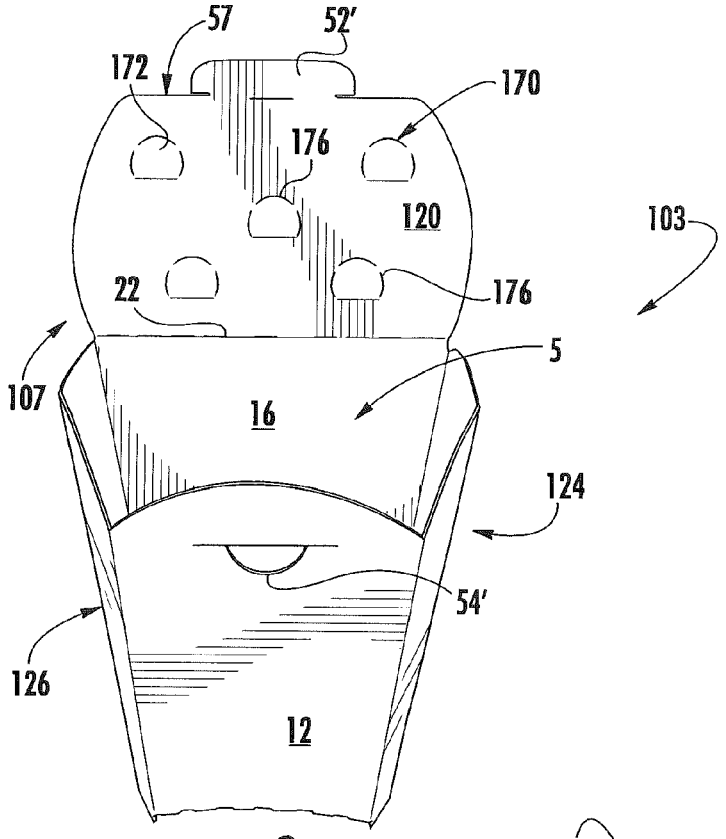
FIG. 9 is a perspective view showing the erected carrier with an open top.
Figure 10:
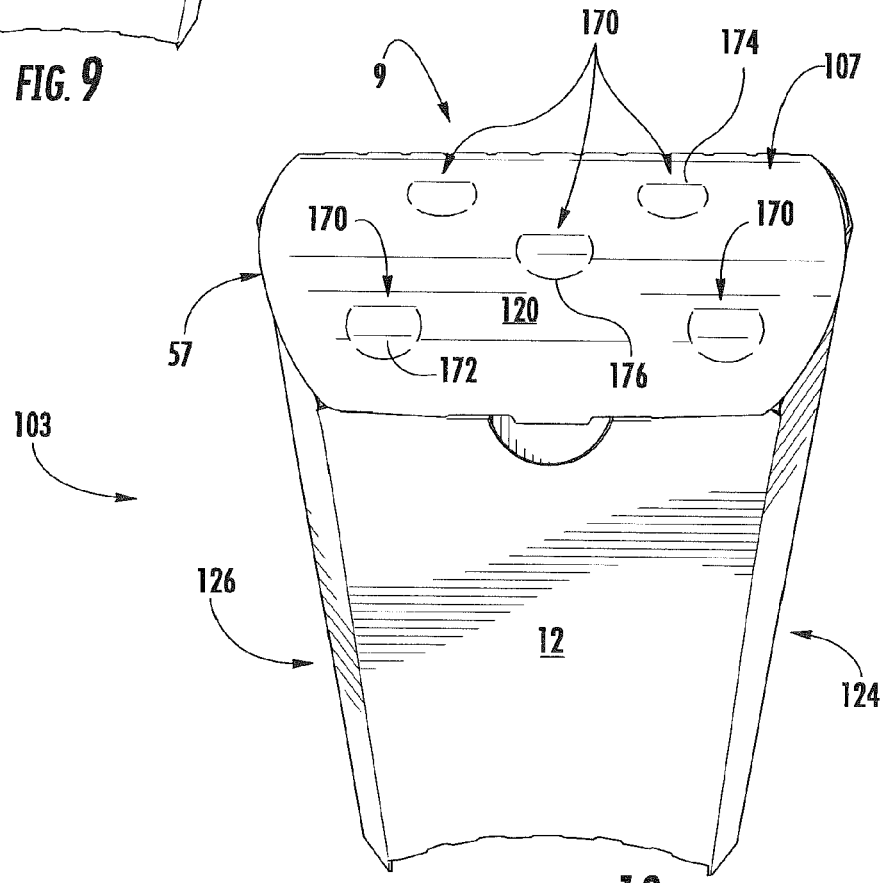
FIGS. 10-12 are perspective views showing the carrier of FIG. 9 with a closed top.
Figure 11:
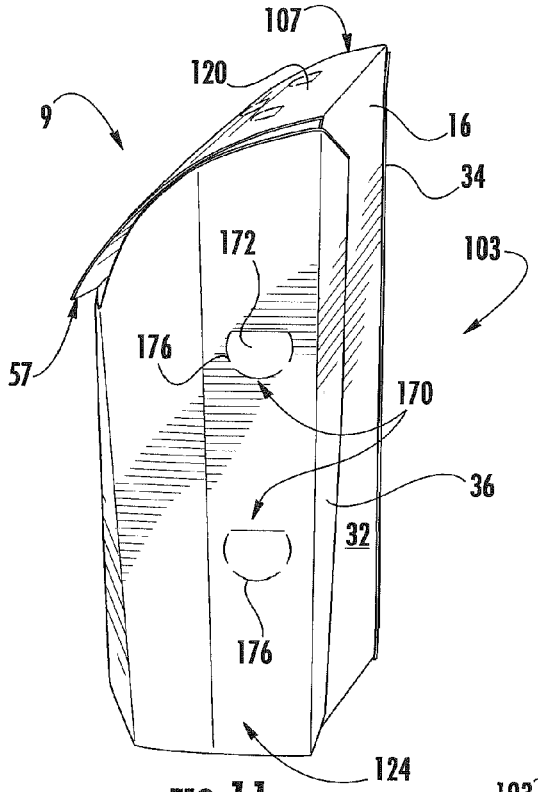
Figure 12:
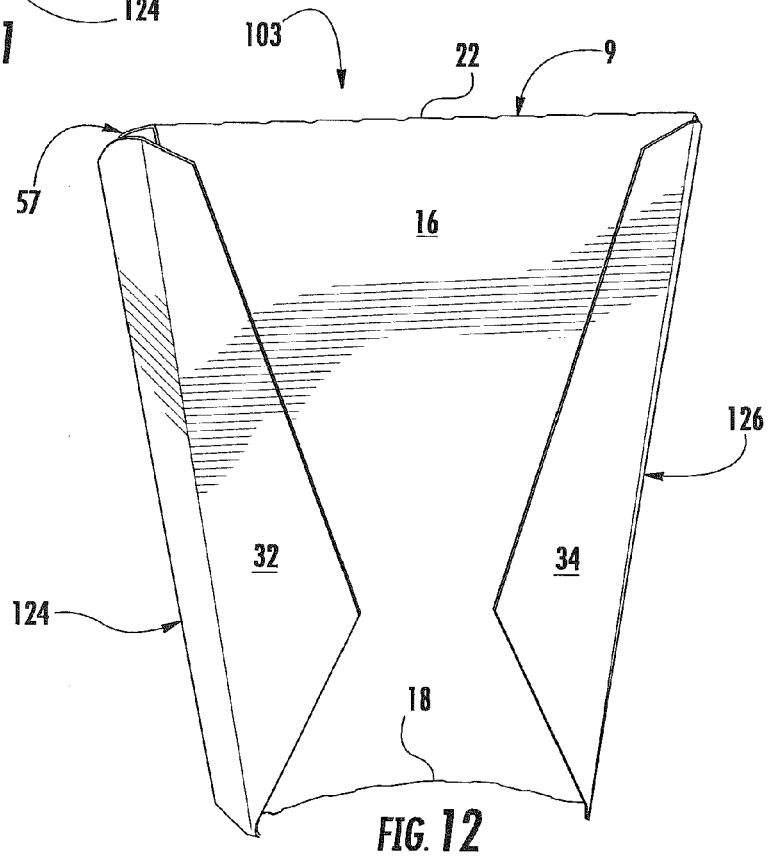

FIG. 8 is a plan view of a blank 101 for forming a carrier 103 (FIGS. 9-15) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 8, the blank 101 includes vent features 170 in integrated lid 107 (including the top panel 120) and in the portions 144*b*, 146*b* of the respective end panels 124, 126. Additional or alternative vent features could be included in the panels and flaps of the blank 101 without departing from the disclosure. Each of the vent features 170 can include a vent flap 172 foldably connected to the top panel 120, the first end panel 124, or the second end panel 126 along a respective fold line 174. Each of the vent features 170 can be at least partially defined by a cut or tear line 176. In one embodiment, the tear lines 176 can include one or more nicks to help hold the vent flap 172 in place until the vent features 170 are actuated.

Figure 13:
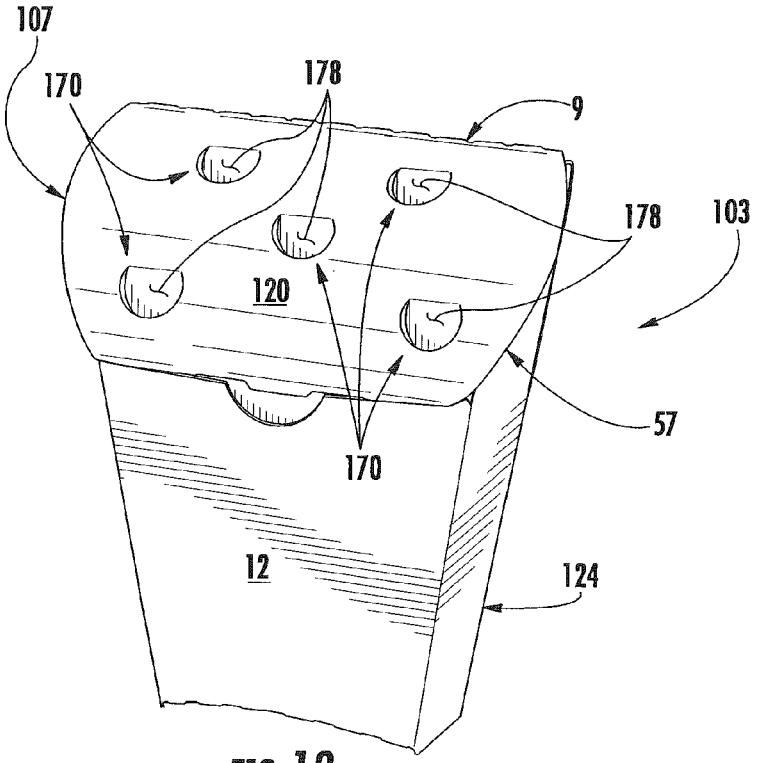
FIGS. 13 and 14 are perspective views showing the carrier of FIGS. 10-12 with actuated vent features.
Figure 14:
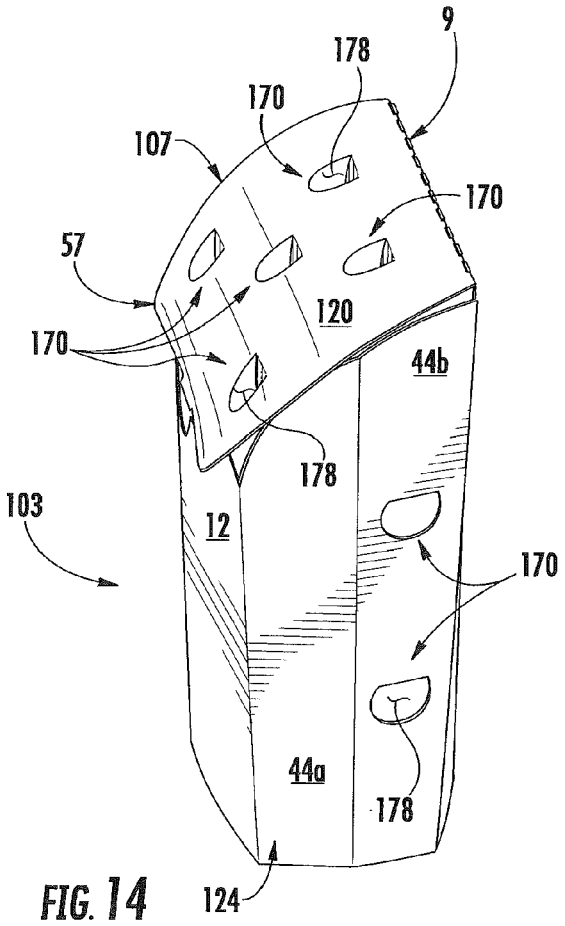
Figure 15:
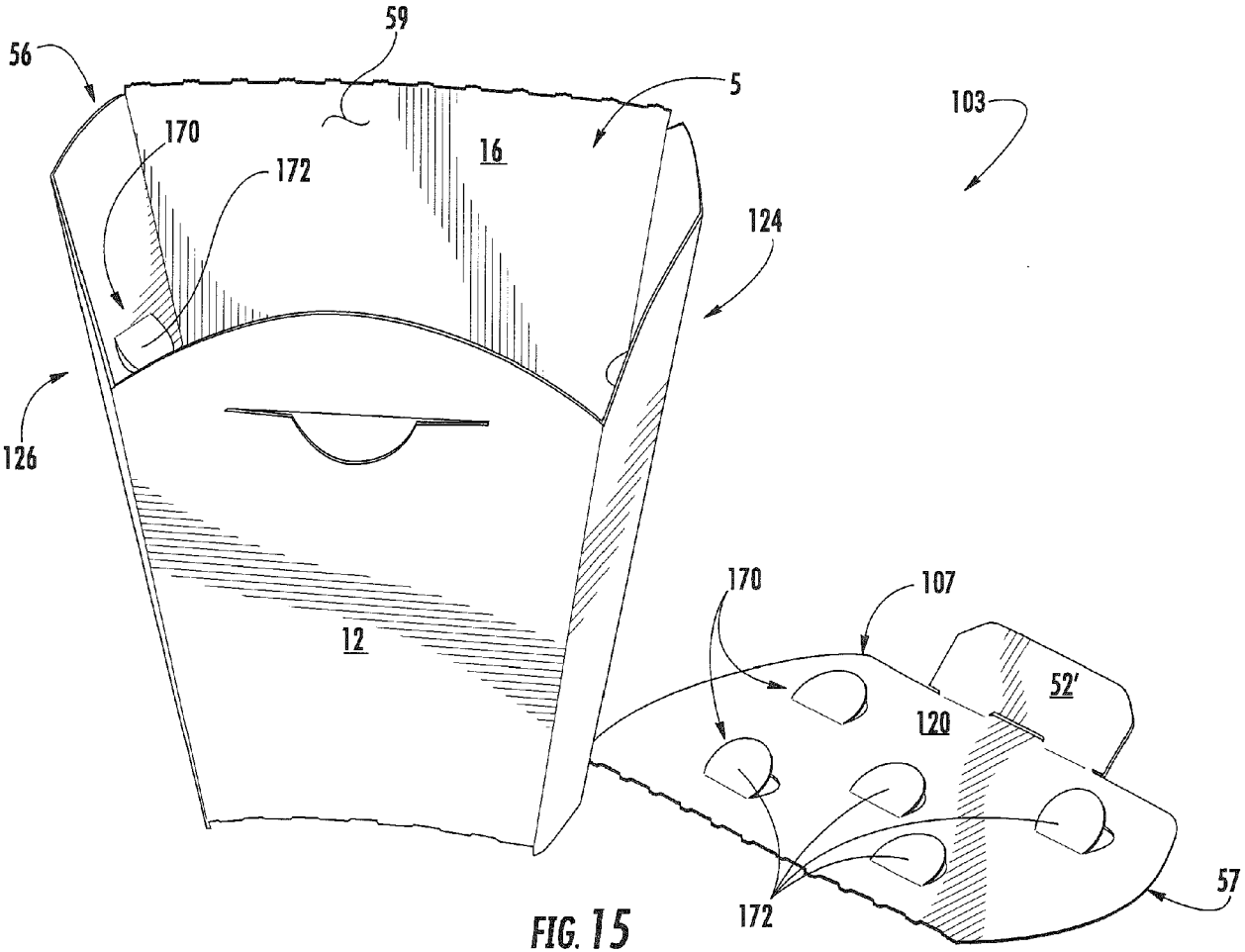
FIG. 15 is a perspective view of the carrier after a dispenser is actuated.

As shown in FIGS. 13-15, the vent features 170 can be actuated to form vent openings 178 by folding the vent flaps 172 inwardly along the fold lines 174. Alternatively, one or more of the vent flaps 172 could be folded outwardly. Accordingly, the vent flaps 172 can be folded inwardly or outwardly along the respective fold lines 174 to move the vent features 170 from a closed position (FIGS. 9-11) to an open or actuated position (FIGS. 13-15). When the vent flaps 172 are actuated, the vent features 170 can at least partially vent the carton 103 so that gases (e.g., steam and/or other forms of moisture and/or other gases or liquids) can enter and/or escape the interior 5 of the carton 103. Accordingly, the vent features 170 can help the carton 103 maintain the product quality as described above. For example, the enclosed interior 5 of the carton with the closed integrated lid 7 can help maintain the heat of fried potatoes, for example, while moisture (e.g., from steam from the fried potatoes) in the interior 5 can escape the carton 3 via one or more of the vent openings 178. Accordingly, the build-up of moisture in the interior 5 of the carton 3 is reduced or eliminated, and the fried potatoes can maintain their product attributes (e.g., can remain hot and crisp) longer than if they were contained in an open container (e.g., no lid) or an enclosed container with no vent features. The vent features 170 could be otherwise shaped, arranged, positioned, and/or configured without departing from the disclosure.

As shown in FIG. 8, the bottom panel 110 can include oblique edges so that the fold line 148 connecting the portions 150*a*, 150*b* of the bottom panel is longer relative to the fold line 48 of the first embodiment. The blank 101 and the carton 103 could be otherwise shaped, arranged, and/or configured without departing from the disclosure.

Figure 16A:
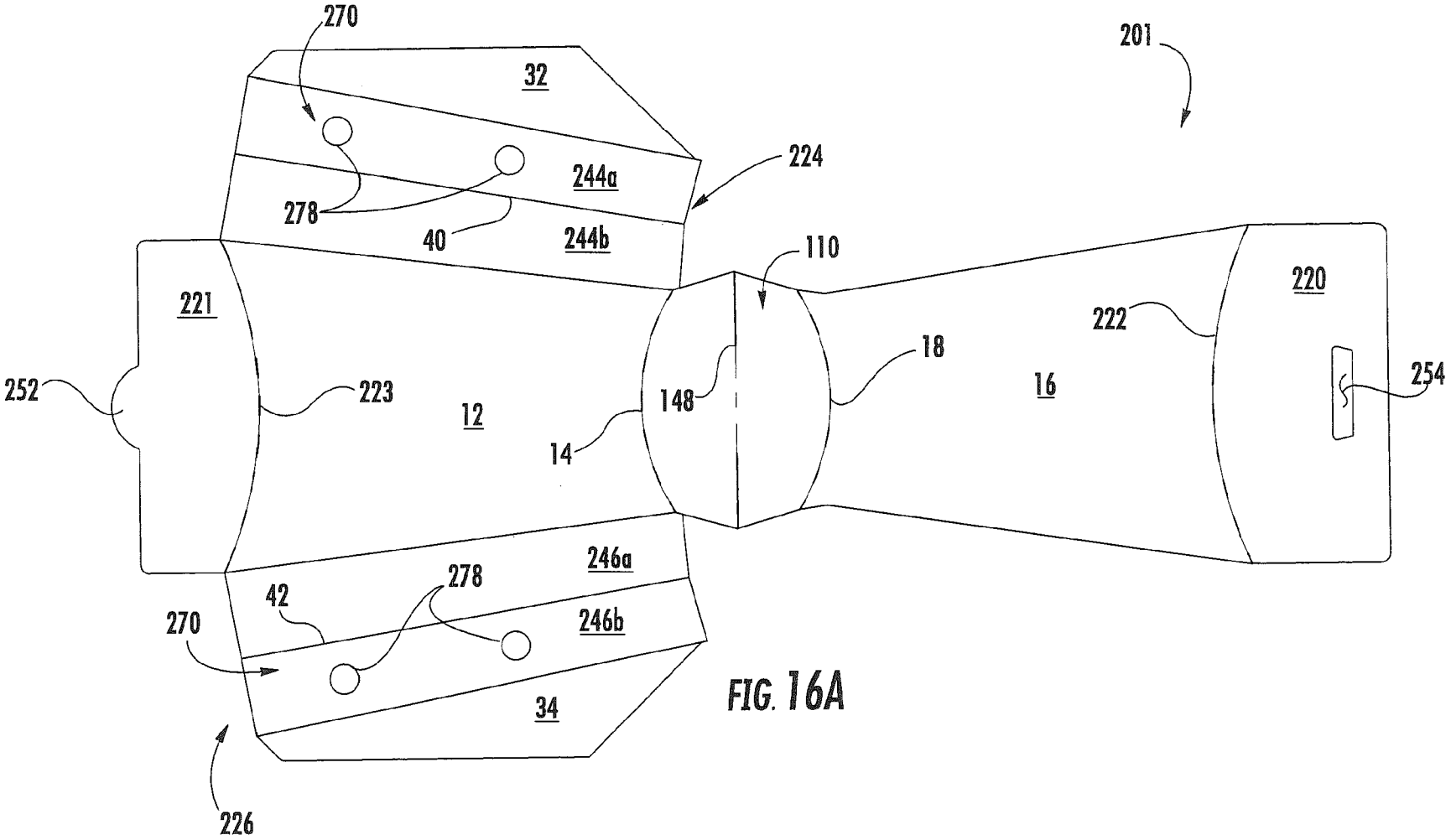
FIG. 16A is a plan view of a blank used to form a carrier according to a third embodiment of the disclosure.
Figure 16B:
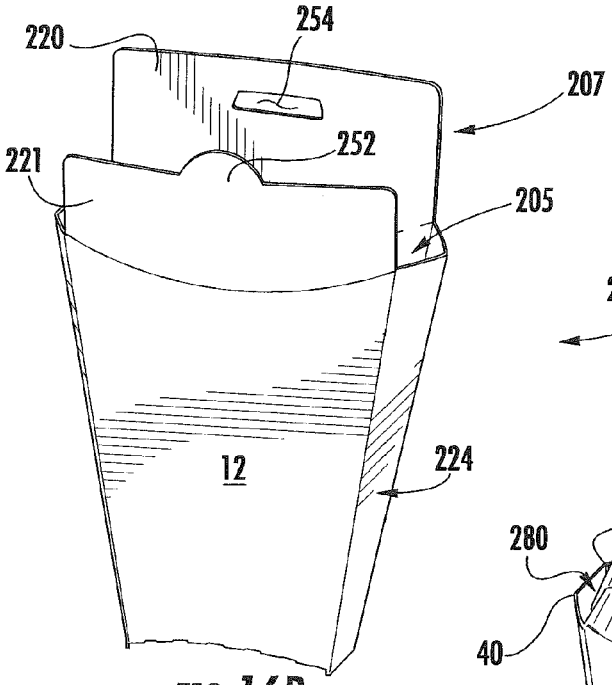
FIG. 16B is a perspective view showing the erected carrier with an open top.
Figure 16C:
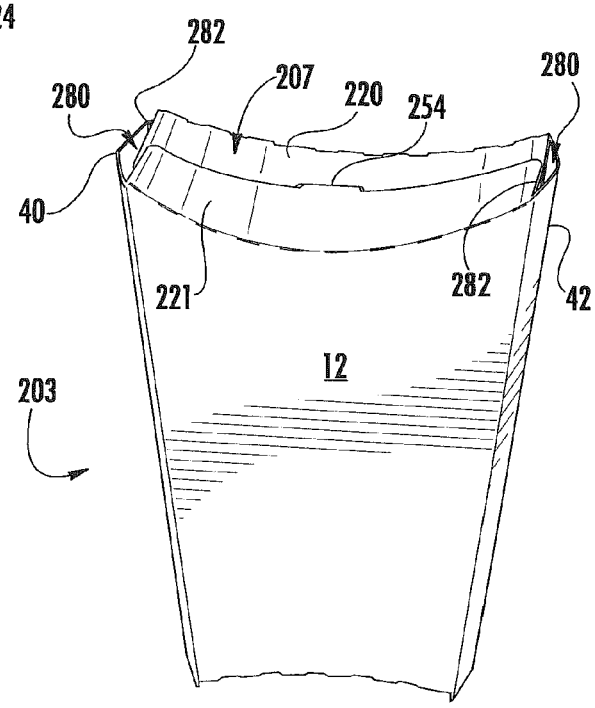
FIGS. 16C and 16D are perspective views showing the carrier of FIG. 16B with a closed top.
Figure 16D:
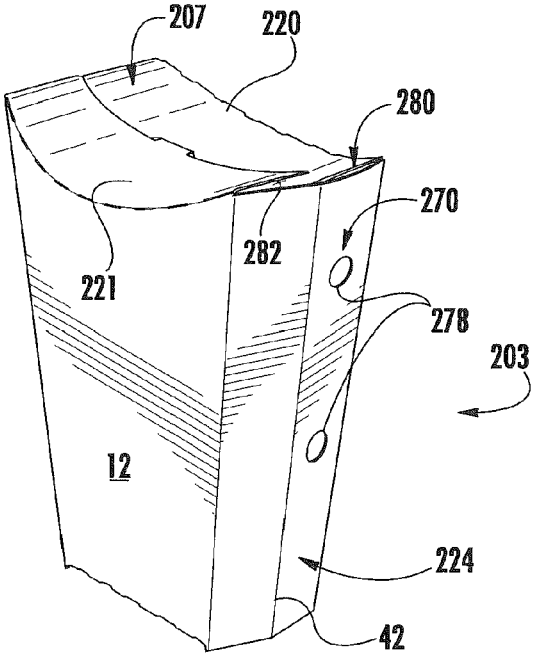

FIG. 16A is a plan view of a blank 201 for forming a carrier 203 (FIGS. 16B-16D) according to a third embodiment of the disclosure. The third embodiment is generally similar to the second embodiment, except for variations noted and variations that will be apparent to one of ordinary skill in the art. Accordingly, similar or identical features of the embodiments have been given like or similar reference numbers. As shown in FIG. 16A, the blank 201 includes a first top panel 220 foldably connected to the second side panel 16 along an arcuate fold line 222 and a second top panel 221 foldably connected to the first side panel 12 at an arcuate fold line 223. The top panels 220, 221 cooperate to form the integrated lid 207 (FIGS. 16B-16C) in the carton 203. In the illustrated embodiment, blank 201 includes closure features, including a closure tab 252 extending from the second top panel 221 and a closure slot or opening 254 disposed in the first top panel 220. In one embodiment, the closure slot 254 is spaced apart from the edge of the first top panel 220. The closure features can help retain the lid 207 in a closed position (FIGS. 16C and 16D) when the top panels 220, 221 are downwardly folded along the respective fold lines 222, 223 from the open position (FIG. 16B) to the closed position (FIGS. 16C and 16D), the closure tab 252 can be at least partially inserted into the closure slot 254. As shown in FIGS. 16C and 16D, the second top panel 221 partially overlaps the first top panel 220 so that the closure tab 252 is received in the closure slot 254 from above. Alternatively, the first top panel 220 can partially overlap the second top panel 221 so that the closure tab 252 extends upwardly into the closure slot 254. The lid 207 could be otherwise shaped, arranged, positioned, and/or configured without departing from the disclosure.

In the illustrated embodiment, the blank 201 includes vent features 270. The vent features 270 can include two spaced apart vent openings 278 in each of the end portions 244*b*, 246*b* of the respective end panels 224, 226. The vent openings 278 can perform similarly to the vent openings 178 formed by the vent flaps 172 in the second embodiment (FIGS. 13-15). As shown in FIGS. 16C and 16D, the vent features further can include upper vent openings 280 defined between the integrated lid 207 and the respective end panels 224, 226. In one embodiment, the end portions 244*a*, 244*b* of the end panel 224 extend in an oblique direction from the side panels 12, 16 to the fold line 40 so that the end panel 224 has a generally V-shaped cross-section. Similarly, the end portions 246*a*, 246*b* of the end panel 226 extend in an oblique direction from the side panels 12, 16 to the fold line 42 so that the end panel 226 has a generally V-shaped cross-section. Accordingly, at the top of the carton 203, the fold lines 40, 42 of the respective end panels 224, 226 are spaced apart from the lid 207, and at least a portion of each of the end portions 244*a*, 244*b*, 246*a*, 246*b* proximate the respective fold lines 40, 42 are spaced apart from the lateral edges 282 of the top panels 220, 221 to form the upper vent openings 280. The vent openings 278, the vent openings 280, and/or other vent features could be omitted or could be otherwise shaped, arranged, positioned, and/or configured without departing from the disclosure.

As shown in FIG. 16A, the end panels 224, 226 of the third embodiment can have a generally different shape than the side panels of the first and second embodiments. The blank 201 and the carton 203 could be otherwise shaped, arranged, and/or configured without departing from the disclosure.

Figure 17A:
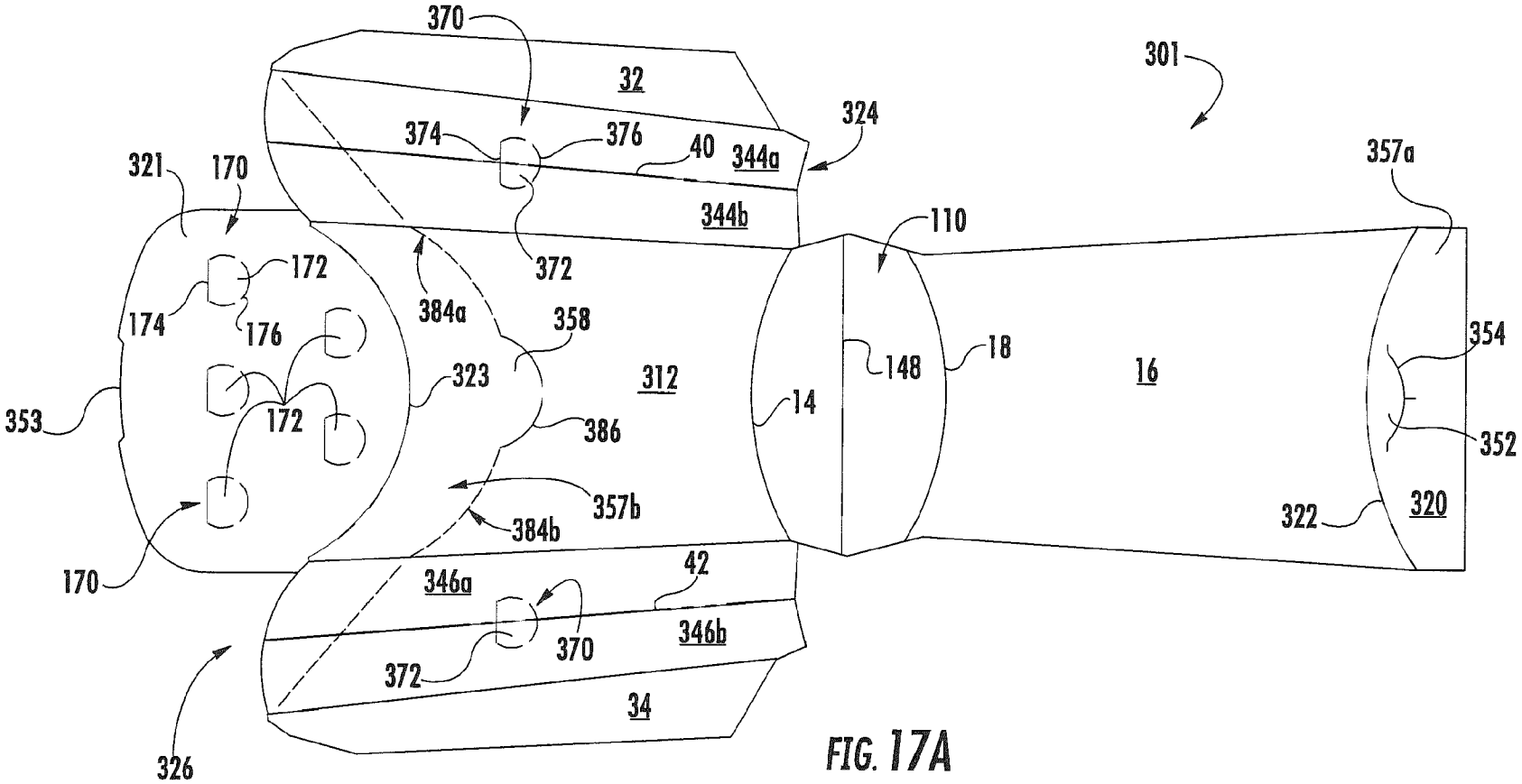
FIG. 17A is a plan view of a blank used to form a carrier according to a fourth embodiment of the disclosure.
Figure 17B:
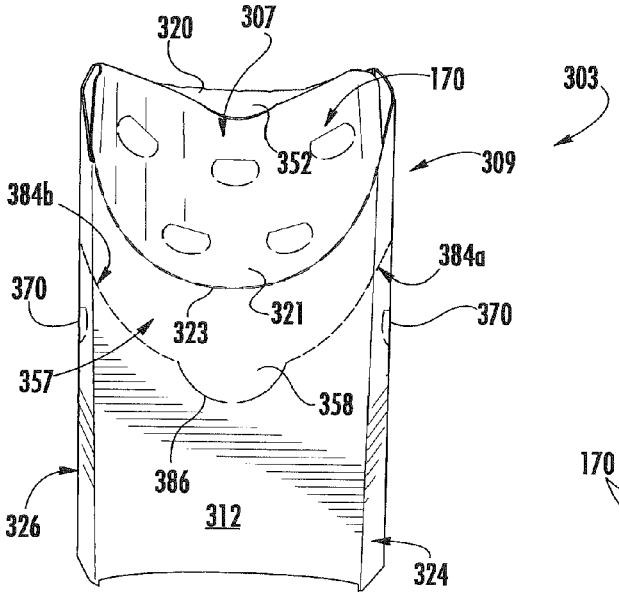
FIG. 17B is a perspective view showing the erected carrier.
Figure 17C:
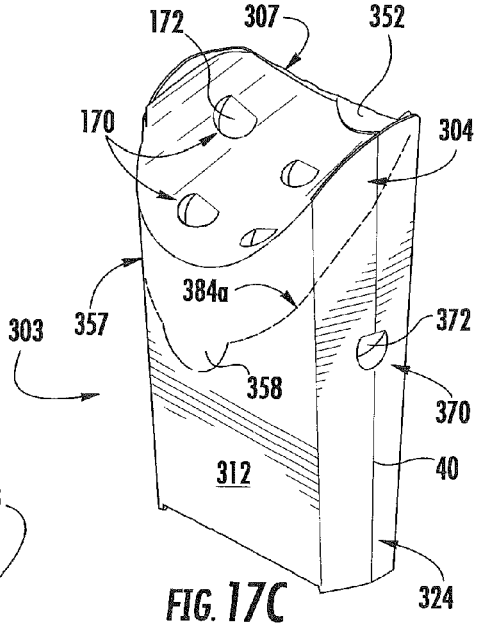
FIG. 17C is a perspective view of the carrier of FIG. 17B with actuated vent features.
Figure 17D:
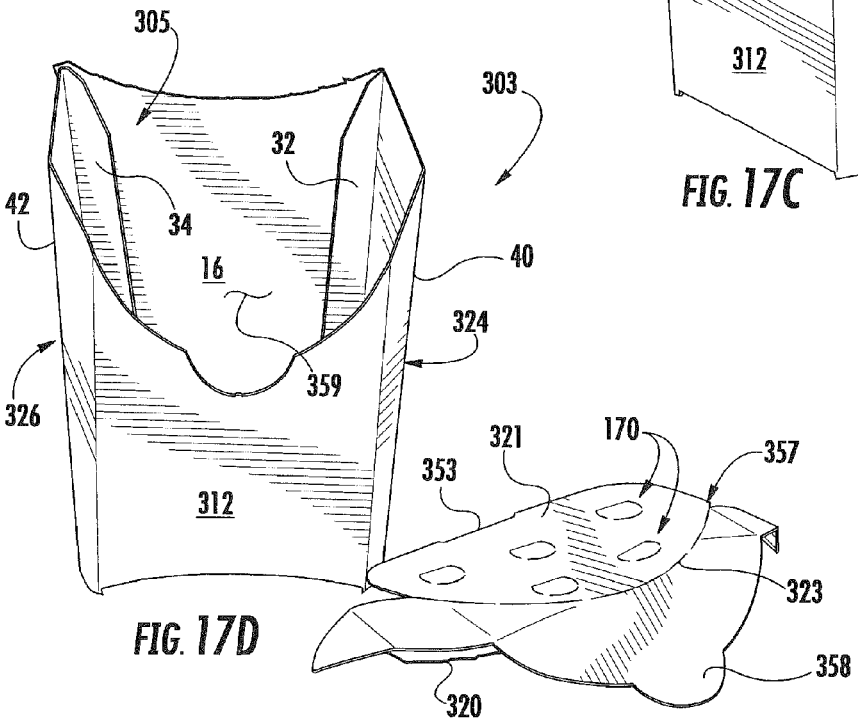
FIG. 17D is perspective view of the carrier after a dispenser is actuated.

FIG. 17A is a plan view of a blank 301 for forming a carrier 303 (FIGS. 17B-17D) according to a fourth embodiment of the disclosure. The fourth embodiment is generally similar to the third embodiment, except for variations noted and variations that will be apparent to one of ordinary skill in the art. Accordingly, similar or identical features of the embodiments have been given like or similar reference numbers. As shown in FIG. 17A, the blank 301 includes a first top panel 320 foldably connected to the second side panel 16 along an arcuate tear line 322, and the first top panel 320 forms a first portion 357*a* of the dispenser panel 357 (FIGS. 17B-17D). Alternatively, the first top panel 320 could be connected to the second side panel 16 along a fold line or other line of weakening. The second top panel 321 is foldably connected to the first side panel 312 along an arcuate fold line 323, and the second top panel 321 can include several vent features 170. The vent features 170 could be omitted, or any suitable number of vent features could be included in the blank 301.

As shown in FIGS. 17B and 17C, the top panels 320, 321 cooperate to form the integrated lid 307 of the carton 303. In the illustrated embodiment, the lid 307 includes closure features, including a closure tab 352 in the first top panel 320. The closure tab 352 can be defined by a cut line or closure slit 354, which is spaced apart from the edges of the first top panel 320 and the fold line 322. The closure features can also include an edge 353 of the second top panel 321 that is at least partially received in the closure slit 354 when the lid 307 is closed (FIGS. 17B and 17C). The closure edge 353 can include a notch (FIG. 17A) in the second top panel 321. Alternatively, the edge 353 could be continuous with the outer edge of the second top panel. As shown in FIGS. 17B and 17C, when the lid 307 is closed, the closure edge 353 of the second top panel 321 can be at least partially received in the closure slot 354 in the first top panel 320 so that the closure tab 352 at least partially overlaps the second top panel 321 adjacent the closure edge 353. Alternatively, the first top panel 320 can at least partially overlap the second top panel 321 and the edge 353 can be at least partially received in the closure slit 354 from below the first top panel 320 so that the second top panel 321 adjacent the edge 353 at least partially overlaps the closure tab 352. The integrated lid 307, including the top panels 320, 321 and/or the closure features, could be omitted or could be otherwise shaped, arranged, positioned, and/or configured without departing from the disclosure.

As shown in FIG. 17A, the blank 301 includes a vent feature 370 in each of the end panels 324, 326. Alternatively, the blank 301 could include any suitable number of vent features 370, or the vent features 370 could be omitted. The vent features 370 can include a vent flap 372 foldably connected to the respective end panel 324, 326 along a respective fold line 374 and can be separable from the respective end panel 324, 326 along a respective cut or tear line 376. In the illustrated embodiment, the vent feature 370 in the first end panel 324 extends in both of the end portions 344*a*, 344*b* so that the fold line 40 extends across the vent flap 372. Similarly, the vent feature 370 in the second end panel 326 extends in both of the end portions 346*a*, 346*b* so that the fold line 42 extends across the vent flap 372. The vent features 370 and/or the end panels 324, 326 could be omitted or could be otherwise shaped, arranged, positioned, and/or configured without departing from the disclosure.

As shown in FIGS. 17B and 17C, the carton includes a dispenser 309 including a dispenser panel 357 at least partially defined by tear lines 322, 384*a*, 384*b*. As shown in FIG. 17A, the blank 301 includes dispenser features for forming the dispenser 309 in the carton 303. The dispenser features can include a first dispenser panel portion 357*a*, comprising the first top panel 320 and at least partially defined by the tear line 322. The dispenser features can also include a second dispenser panel portion 357*b*, comprising the second top panel 321, a portion of the first side panel 312 defined between the arcuate fold line 323 and the tear lines 384*a*, 384*b*, and portions of the end panels 324, 326 respectively defined between a respective edge of the end panel 324, 326 and the respective tear line 384*a*, 384*b*. The dispenser features can also include an access feature 358 (e.g., a tab) in the first side panel 312 defined by a tear or cut line 386. In one embodiment, the cut line 386 can include a nick for helping to retain the access feature 358 in place until the dispenser 309 is actuated. The cut line 358 can extend from a respective end of each of the tear lines 384*a*, 384*b* in the first side panel 312.

In one embodiment, when the carton 303 is formed, the dispenser panel 357 includes an upper portion of the carton 303 including the integrated lid 307, and the ends of the tear lines 384*a*, 384*b* in the end panels 324, 326 can extend upwardly toward the upper edges of the end panels and toward the respective ends of the arcuate tear line 322. In the illustrated embodiment, the dispenser 309 can be actuated to remove the dispenser panel 357 by pushing the access feature 358 inwardly, separating the access feature from a lower portion of the first side panel 312 along the cut line 386. The dispenser panel 357 can be grasped at the access feature 358 and pulled upwardly to tear the dispenser panel away from the lower portions of the first side panel 312 and the end panels 324, 326 along the tear lines 384*a*, 384*b*. After tearing along the tear lines 384*a*, 384*b*, the dispenser panel 357 can be further removed by tearing the first top panel 320 (the first dispenser panel portion 357*a*) away from the second side panel 16 along the arcuate tear line 322 (FIG. 17D). Alternatively, the second dispenser panel portion 357*b* can be disengaged from the first dispenser panel portion 357*a* by removing the second top panel 321 from the closure slit 354 in the first top panel 320, and the first top panel 320 can remain attached to the first side panel 16. Accordingly, the dispenser opening 359 is formed at the top of the carton 303 when the dispenser panel 357 is removed (FIG. 17D), or when the dispenser panel portion 357*b* is removed, and a user can access the food product in the interior 305 of the carton 303.

The dispenser could be omitted or could be otherwise shaped, arranged, positioned, and/or configured without departing from the disclosure. For example, in an alternative embodiment, the dispenser panel includes the dispenser panel portion 357*b*, the first top panel 320 is not part of the dispenser panel, and the first top panel 320 is connected to the first side panel 16 at a fold line. The blank 301 and the carton 303 could be otherwise shaped, arranged, and/or configured without departing from the disclosure.

Figure 18A:
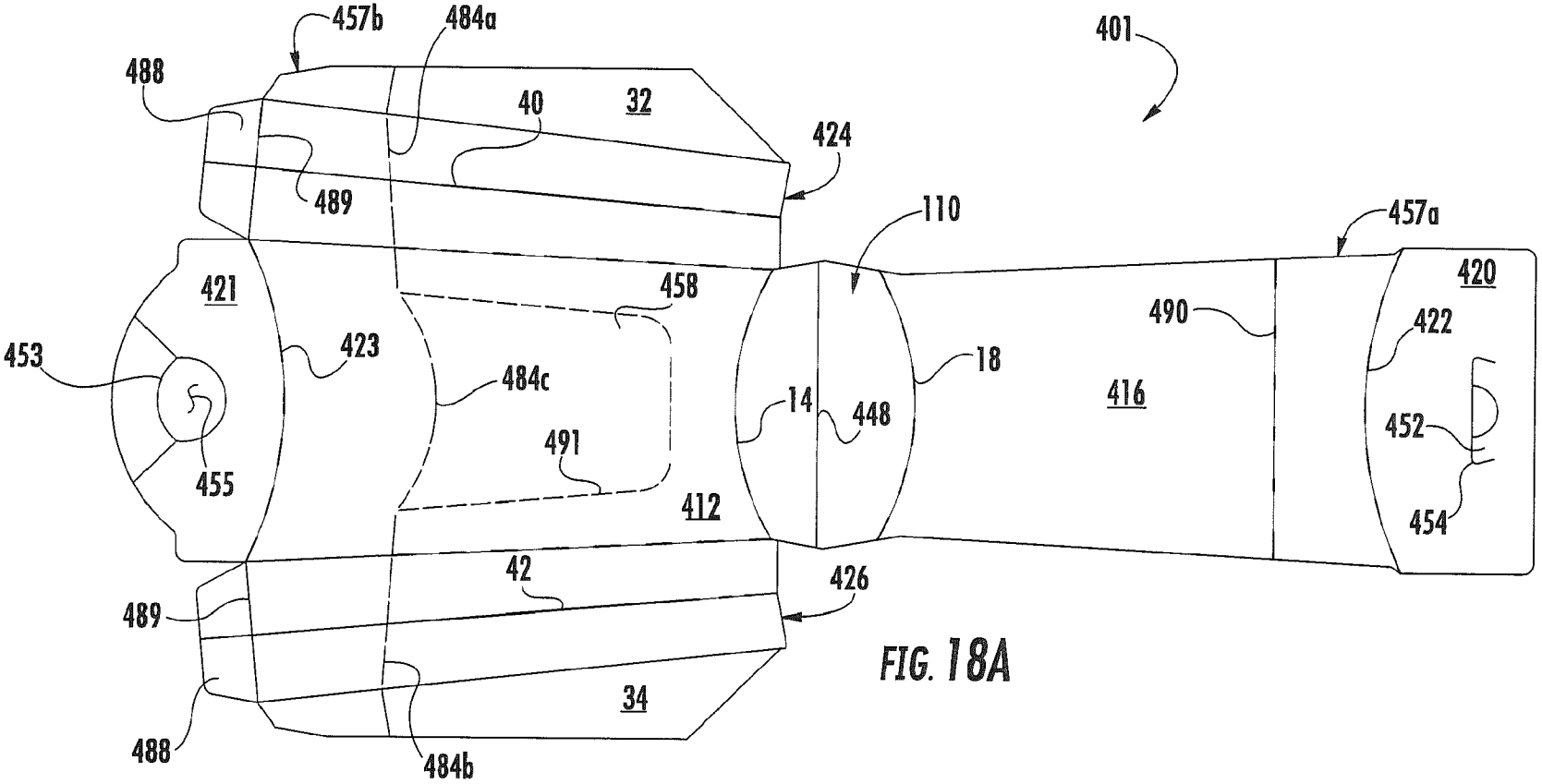
FIG. 18A is a plan view of a blank used to form a carrier according to a fifth embodiment of the disclosure.
Figure 18B:
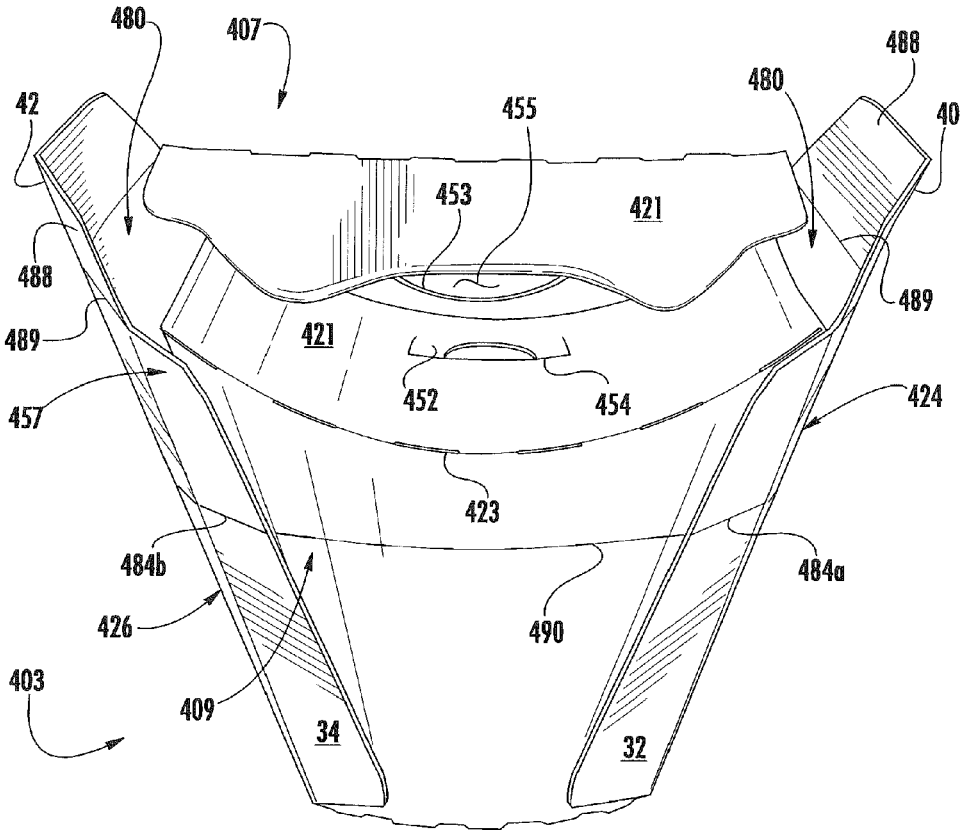
FIG. 18B is a perspective view showing the erected carrier.

FIG. 18A is a plan view of a blank 401 for forming a carrier 403 (FIG. 18B) according to a fifth embodiment of the disclosure. The fifth embodiment is generally similar to the fourth embodiment, except for variations noted and variations that will be apparent to one of ordinary skill in the art. Accordingly, similar or identical features of the embodiments have been given like or similar reference numbers. As shown in FIG. 18A, the blank 401 includes a first top panel 420 foldably connected to the second side panel 416 along an arcuate fold line 422 and a second top panel 421 foldably connected to the first side panel 412 along an arcuate fold line 423. The top panels 420, 421 form an integrated lid 407 as shown in FIG. 18B, for example. The first top panel 420 includes a closure slit and opening 454 forming a closure tab 452 that is spaced apart from the edges of the first top panel 420. The second top panel 421 includes an opening 455 and an engagement edge 453 adjacent the opening 455. Fold lines adjacent the opening 455 can help adjust the edge of the second top panel 421 to engage the closure tab 452 when closing the lid 407.

In the illustrated embodiment, each of the end panels 424, 426 can include an upper end flap 488 foldably connected to the respective end panel along a respective fold line 489. As shown in FIG. 18A, the fold lines 40, 42 extend in the upper end flaps 488. In one embodiment, the upper end flaps could be omitted, and the end panels could extend upwardly past the closed lid 407. As shown in FIG. 18B, the upper end flaps 488 can extend upwardly adjacent the upper vent features 480 in the carton 403. In one embodiment, the upper vent features 480 generally are similar to the upper vent features 280 (FIGS. 16C and 16D). The integrated lid 407 and/or the end panels 424, 426 could be omitted or could be otherwise shaped, arranged, positioned, and/or configured without departing from the disclosure.

As shown in FIG. 18A, the blank 401 can include dispenser features for forming a dispenser 409 (FIG. 18B) with a dispenser panel 457 defined by tear lines 484*a*, 484*b*, 484*c* in the first side panel 412 and the end panels 424, 426 and a tear line 490 in the second side panel 416. The dispenser 409 can include a second dispenser panel 458 defined by the tear line 484*c* and a generally U-shaped tear line 491 in the first side panel 412. The dispenser panel 457 includes a first dispenser panel portion 457*a*, including the first top panel 420 and an upper portion of the second side panel 416, and a second dispenser panel portion 457*b*, including the second top panel 421, the upper end flaps 488 and upper portions of the first side panel 412 and the end panels 424, 426. In one embodiment, the dispenser 409 can be actuated to form a dispenser opening (not shown) in the carton 403 by removing the dispenser panel 457, tearing along the tear lines 484*a*, 484*b*, 484*c*, 490. The dispenser opening can be expanded by tearing the second dispenser panel 458 along the U-shaped tear line 491. Alternatively, the dispenser panels 457, 458 can be removed together to form the dispenser opening. In a further alternative, the second dispenser panel 458 could be removed while the dispenser panel 357 remains at least partially intact. The dispenser 409 could be omitted or could be otherwise shaped, arranged, positioned, and/or configured without departing from the disclosure.

The blank 401 and the carton 403 could be otherwise shaped, arranged, and/or configured without departing from the disclosure.

Figure 19A:
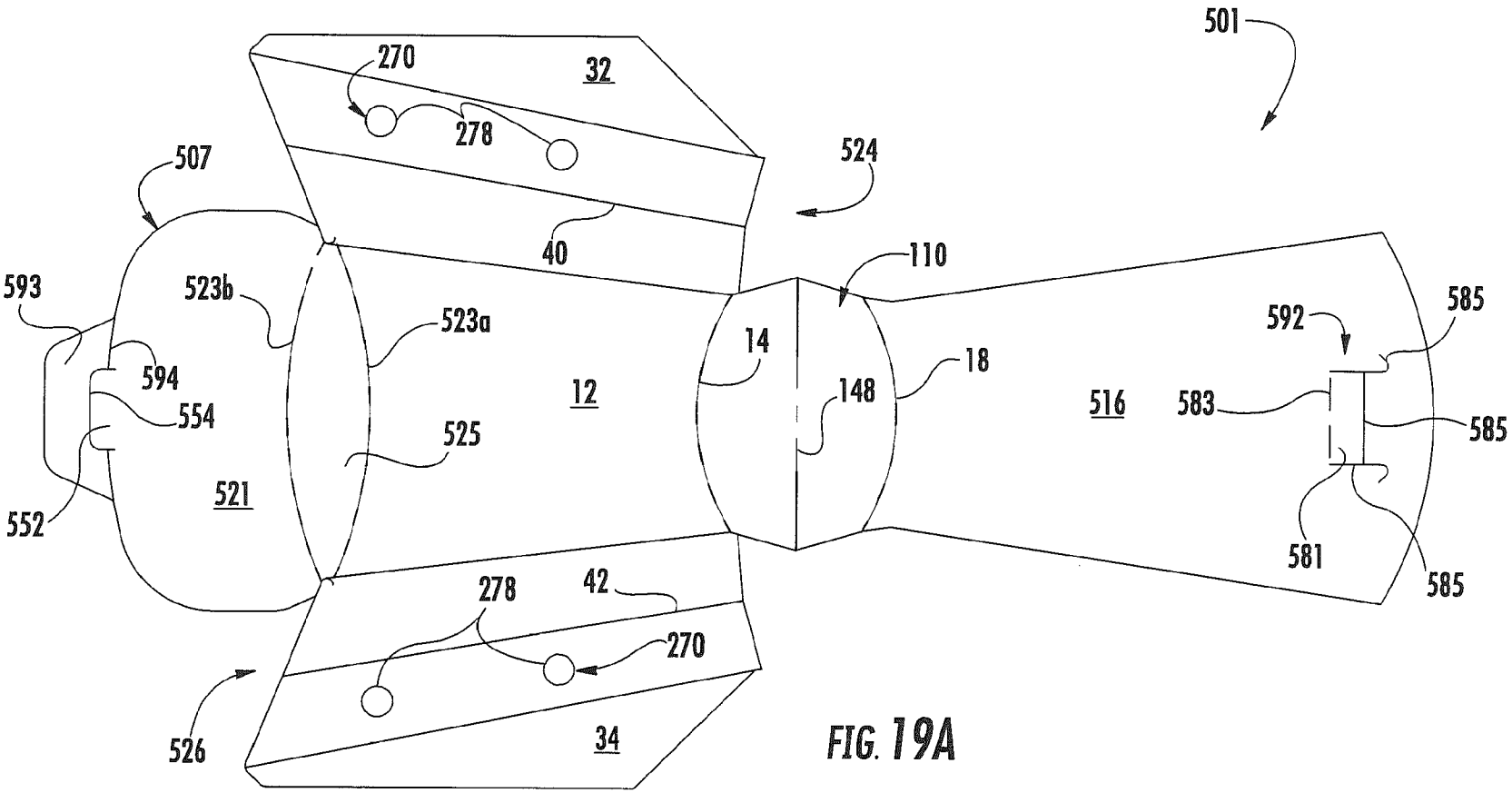
FIG. 19A is a plan view of a blank used to form a carrier according to a sixth embodiment of the disclosure.
Figure 19B:
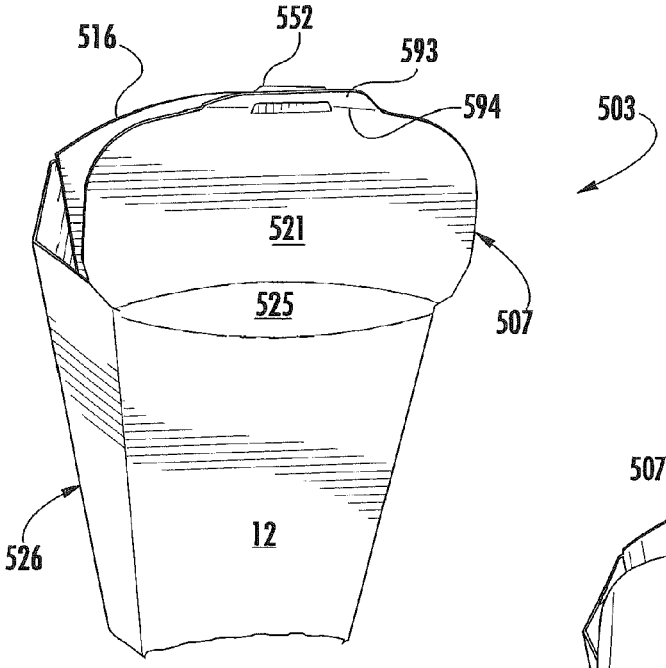
FIG. 19B is a perspective view showing the erected carrier with an open top.
Figure 19C:
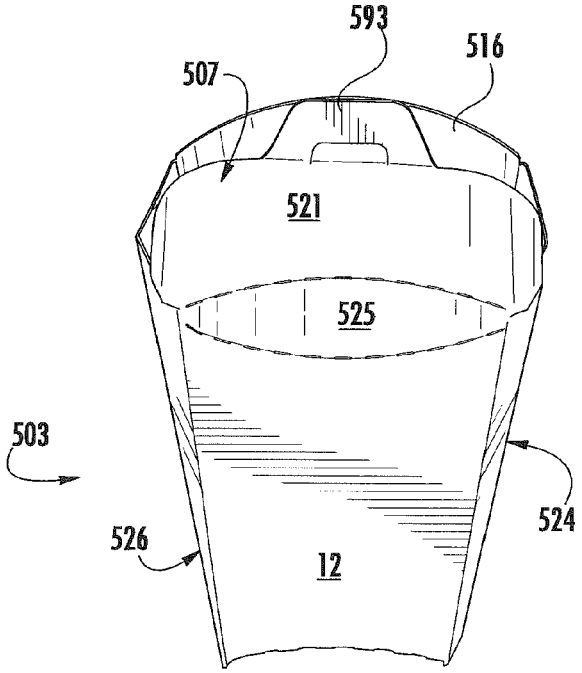
FIGS. 19C and 19D are perspective views showing the carrier of FIG. 19B with a closed top.
Figure 19D:
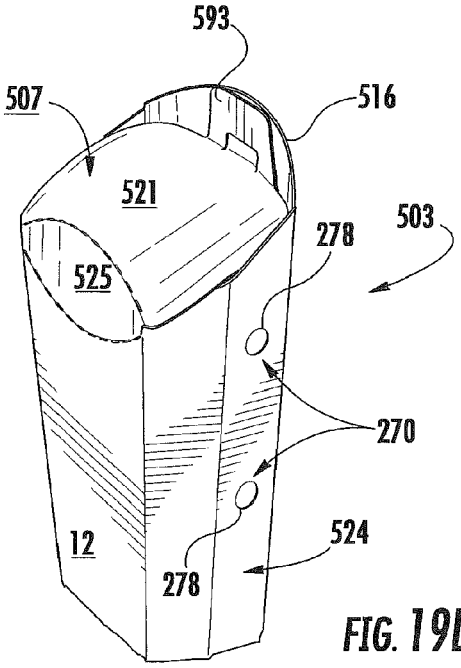

FIG. 19A is a plan view of a blank 501 for forming a carrier 503 (FIGS. 19B-19D) according to a sixth embodiment of the disclosure. The sixth embodiment is generally similar to the third embodiment (e.g., FIGS. 16A-16D), except for variations noted and variations that will be apparent to one of ordinary skill in the art. Accordingly, similar or identical features of the embodiments have been given like or similar reference numbers. As shown in FIG. 19A, the blank 501 includes one top panel 521 foldably connected to the first side panel 12 along opposing arcuate fold lines 523*a*, 523*b*, which can form an intermediate panel 525 therebetween. As shown in FIGS. 19B-19D, the top panel 521 and the intermediate panel 525 can cooperate to form the integrated lid 507. The lid 507 can include closure features, including a closure tab 552 and a receiving feature 592. The closure tab 552 can be defined by a cut line 554 extending in the top panel 521 and a closure flap 593, which can be foldably connected to the top panel 521 along a fold line 594. The fold line 594 can be interrupted by the closure tab 554. As shown in FIG. 19A, the receiving feature 592 can include a receiver flap 581 foldably connected to the second side panel 516 along a fold line 583 and is spaced apart from the edges of the second side panel 516. In one embodiment, the second side panel 516 can be longer than the first side panel 12 so that the lid 507 extends generally across the top of the carton 503 to engage the receiving feature 592 when the lid 507 is closed (FIGS. 19C and 19D). The receiver flap 581 can be separable from the second side panel 516 along cut lines 585, and the outer cut lines can have hook-shaped cuts to help prevent unwanted tearing in one embodiment. Alternatively, the receiving feature 581 could be replaced by a closure slit or opening. In the illustrated embodiment, the lid 507 is closed by folding the top panel 521 and the intermediate panel 525 along fold lines 523*a*, 523*b* and folding the closure flap upwardly along fold line 594. The closure tab 552 is pushed against the receiver flap 581 to fold the receiver flap outwardly along fold line 583, and the closure tab 552 is inserted into the resulting opening in the second side panel (FIGS. 19C and 19D). With the lid closed, the closure flap 593 extends upwardly from the top panel 521 and can be in face-to-face contact with the second side panel 516.

As shown in FIGS. 19A and 19D, the end panels 524, 526 are generally similar to the end panels 224, 226 in the third embodiment, including the vent features 270. The integrated lid 507 and/or the end panels 524, 526 could be omitted or could be otherwise shaped, arranged, positioned, and/or configured without departing from the disclosure. The blank 501 and the carton 503 could be otherwise shaped, arranged, and/or configured without departing from the disclosure.

Figure 20A:
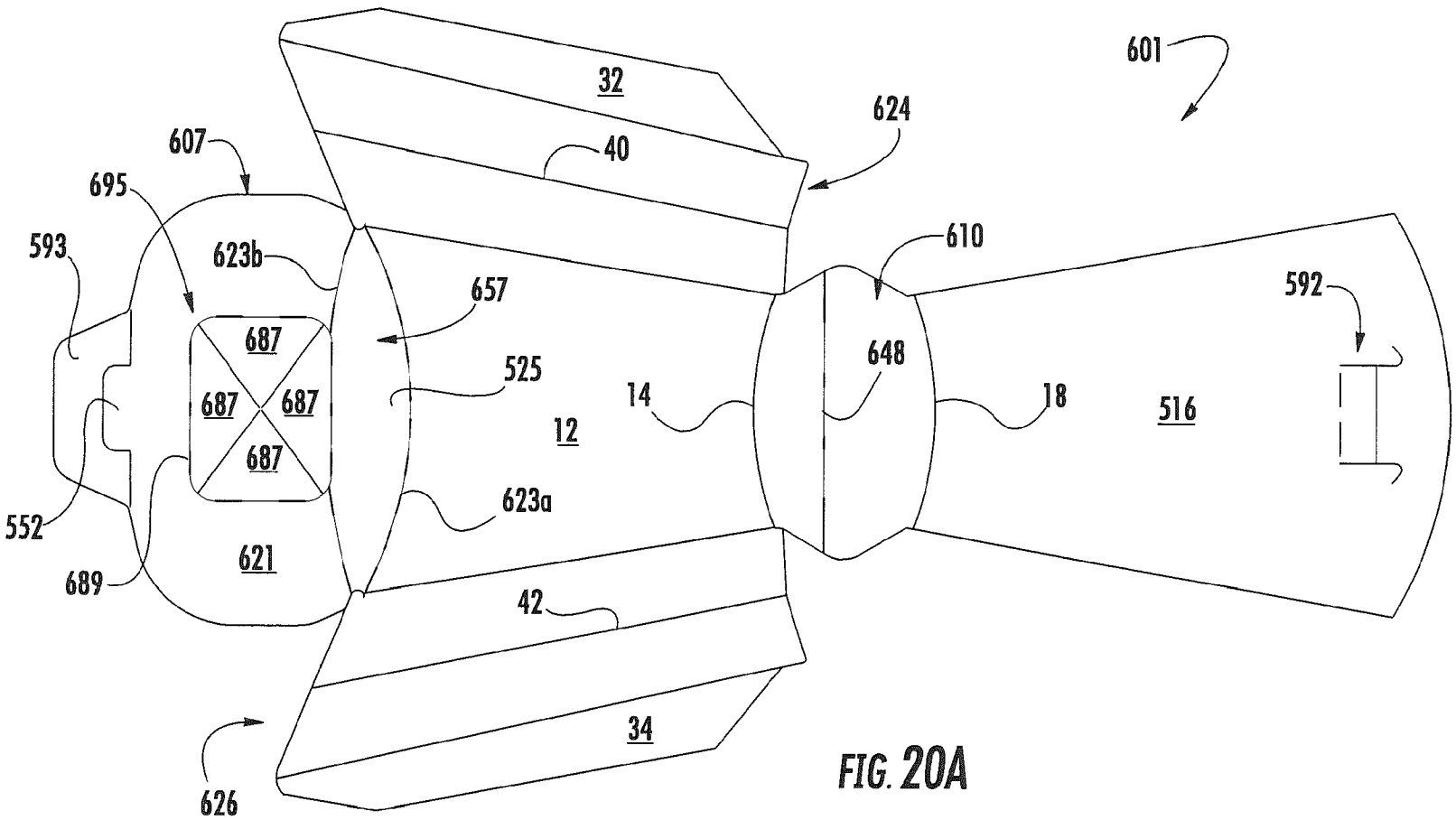
FIG. 20A is a plan view of a blank used to form a carrier according to a seventh embodiment of the disclosure.
Figure 20B:
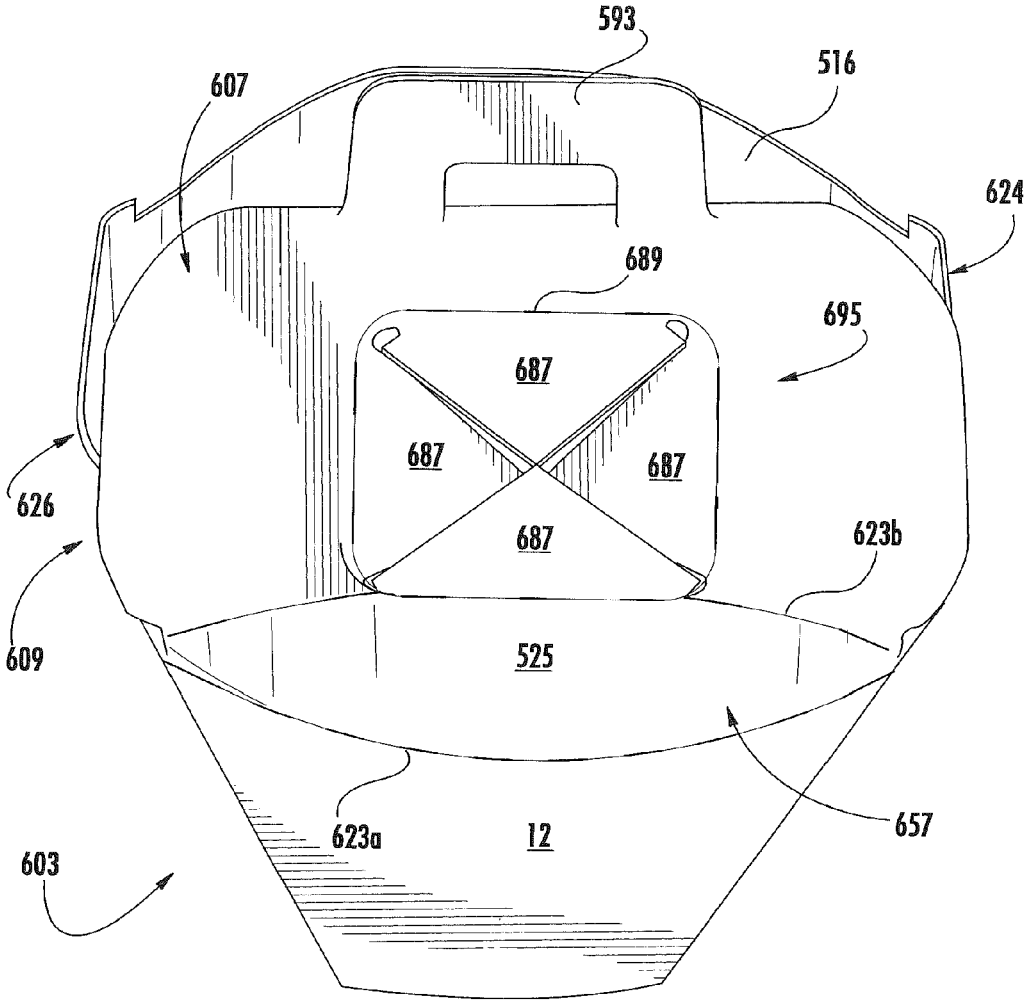
FIGS. 20B and 20C are perspective views showing the erected carrier with a closed top.
Figure 20C:
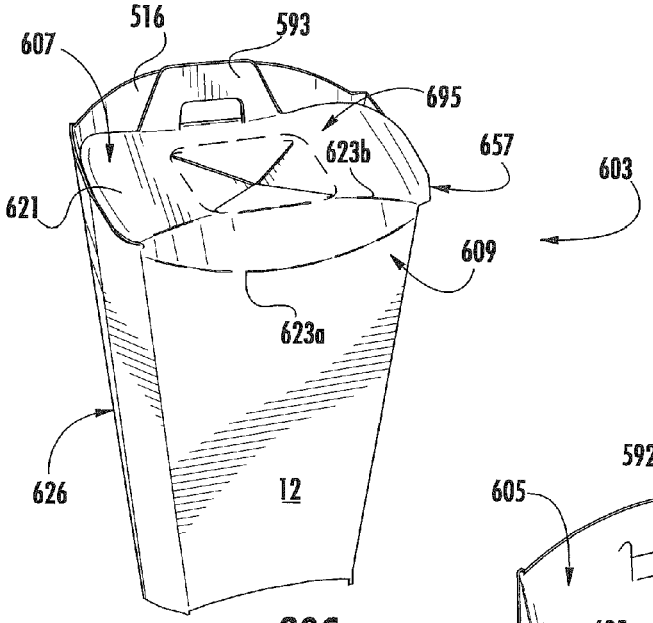
Figure 20D:
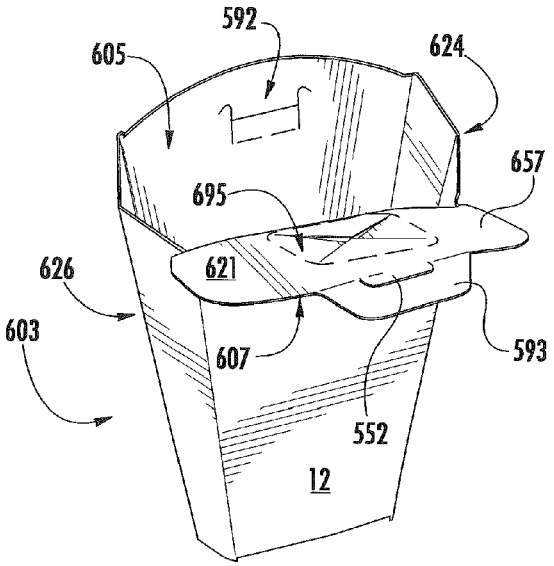
FIG. 20D is a perspective view of the carrier of FIGS. 20B and 20C with an open top.

FIG. 20A is a plan view of a blank 601 for forming a carrier 603 (FIGS. 20B-20E) according to a seventh embodiment of the disclosure. The seventh embodiment is generally similar to the sixth embodiment, except for variations noted and variations that will be apparent to one of ordinary skill in the art. Accordingly, similar or identical features of the embodiments have been given like or similar reference numbers. As shown in FIG. 20A, the blank 601 includes an asymmetric bottom panel 610 with a generally different shape than the bottom panels of the previous embodiments. The vent features 270 are omitted from the end panels 624, 626, which are otherwise similar to the end panels 524, 526 of FIG. 19A. An accessory support feature 695 is included in the top panel 621 for receiving and/or supporting an accessory, such as a dipping sauce container, for example. The accessory support feature 695 includes four triangular flaps 687 foldably connected to the top panel 521 along a fold line 689. The accessory support feature 695 can be used by pushing a sauce container or other article downwardly through the feature 695, pivoting the flaps 867 downwardly when the lid 607 is in an open position (FIG. 20D) or closed position (FIGS. 20B and 20C).

Figure 20E:
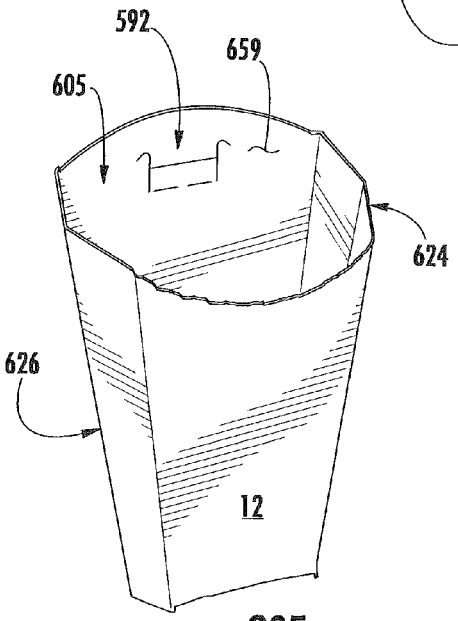
FIG. 20E is perspective view of the carrier of FIG. 20D after a dispenser is actuated.

In the illustrated embodiment, the blank 601 includes dispenser features for forming a dispenser 609 in the carton 603. The dispenser features include a dispenser panel 657 defined by a tear line 623*a*. The dispenser panel 657 can be removed from the carton 603 by tearing along the tear line 623*a* to form a dispenser opening 659 (FIG. 20E). The lid 607, the accessory support feature 695, and/or the dispenser 609 could be omitted or could be otherwise shaped, arranged, positioned, and/or configured without departing from the disclosure. The blank 601 and the carton 603 could be otherwise shaped, arranged, and/or configured without departing from the disclosure.

Figure 21A:
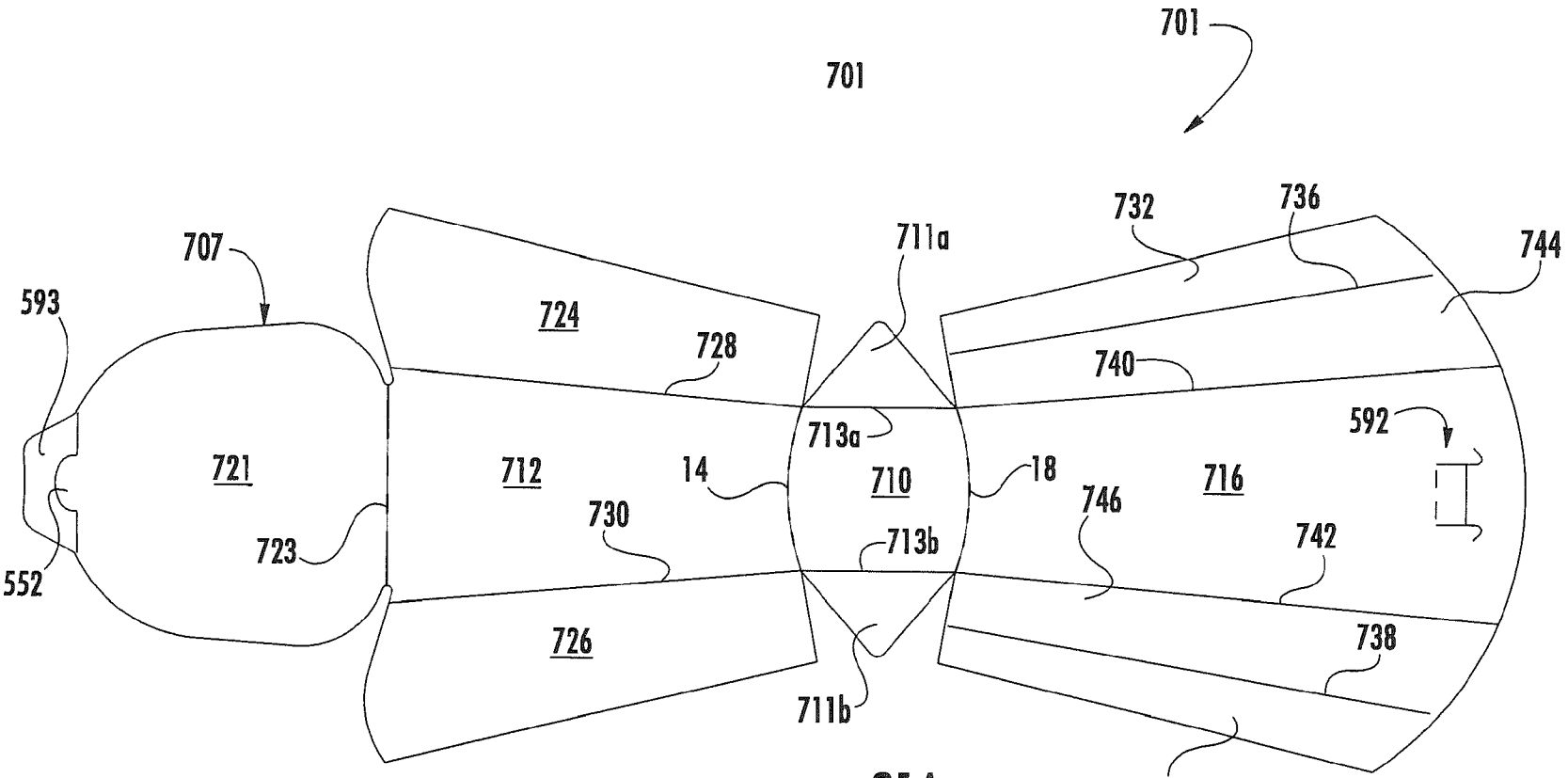
FIG. 21A is a plan view of a blank used to form a carrier according to an eighth embodiment of the disclosure.

FIG. 21A is a plan view of a blank 701 for forming a carrier 703 (FIGS. 21B and 21C) according to an eighth embodiment of the disclosure. The eighth embodiment is generally similar to the sixth embodiment, except for variations noted and variations that will be apparent to one of ordinary skill in the art. Accordingly, similar or identical features of the embodiments have been given like or similar reference numbers. As shown in FIG. 21A, the blank 701 includes a bottom panel 710 foldably connected to the side panels 712, 716 along respective fold lines 14, 18. The bottom panel 710 can include bottom flaps 711*a*, 711*b* foldably connected to the bottom panel 710 along respective fold lines 713*a*, 713*b*. In one embodiment, the bottom flaps 711*a*, 711*b* are generally triangular. The bottom panel 710 and the bottom end flaps 711*a*, 711*b* could be omitted or could be otherwise shaped, arranged, positioned, and/or configured without departing from the disclosure.

Figure 21B:
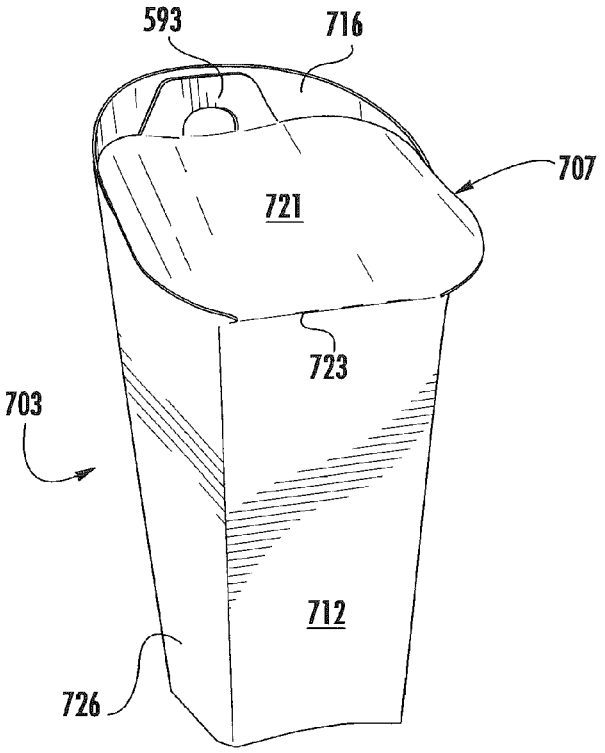
FIG. 21B is a perspective view showing the erected carrier with a closed top.
Figure 21C:
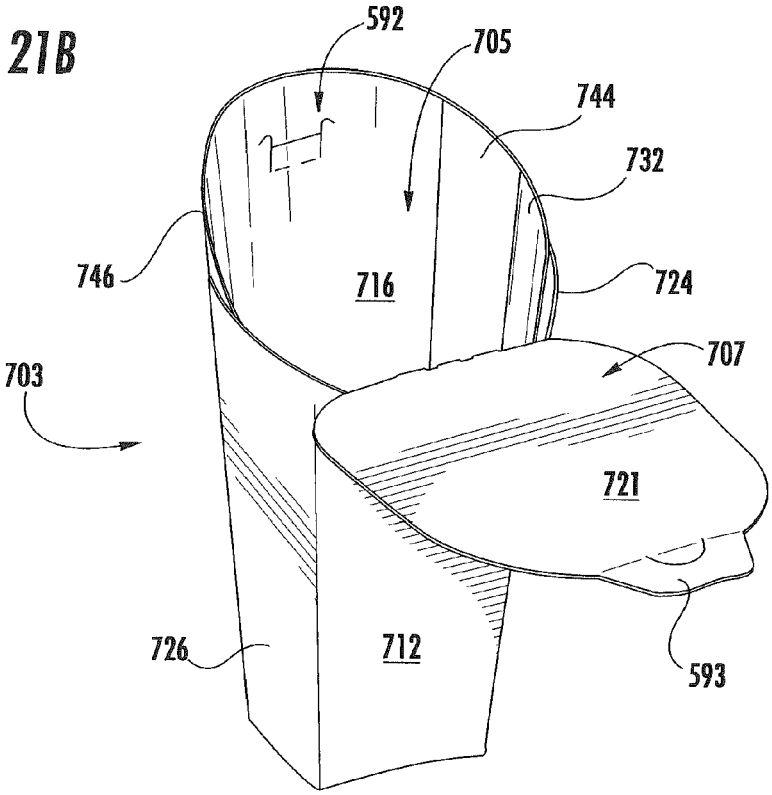
FIG. 21C is a perspective view showing the erected carrier of FIG. 21B with an open top.

As shown in FIG. 21A, the blank 701 can include end panels 724, 726 foldably connected to the first side panel 712 along respective fold lines 728, 730 and end panels 744, 746 foldably connected to the second side panel 716 along respective fold lines 740, 742. In one embodiment, the fold lines 728, 740 can be generally continuous with the fold line 713*a*, and the fold lines 730, 742 can be generally continuous with the fold line 713*b*. Alternatively, the fold lines could be offset. Attachment flaps 732, 734 can be foldably connected to the side panels 744, 746 along respective fold lines 736, 738. When the carton 703 is formed, the attachment flaps 732, 734 can be glued to the respective side panels 724, 726, and the bottom flaps 711*a*, 711*b* can be overlapped with the respective side panels 724, 744 and 726, 746 to form the ends of the carton (FIGS. 21B and 21C). Any of the end panels and/or attachment flaps could be omitted or could be otherwise shaped, arranged, positioned, and/or configured without departing from the disclosure.

In the illustrated embodiment, the integrated lid 707 can include a top panel 721 foldably connected to the first side panel 721 along a generally straight fold line 723. In an alternative embodiment, the fold lines 723 could be arcuate and/or could be a tear line. The lid 707 could be omitted or could be otherwise shaped, arranged, positioned, and/or configured without departing from the disclosure. The blank 701 and the carton 703 could be otherwise shaped, arranged, and/or configured without departing from the disclosure.

Figure 22A:
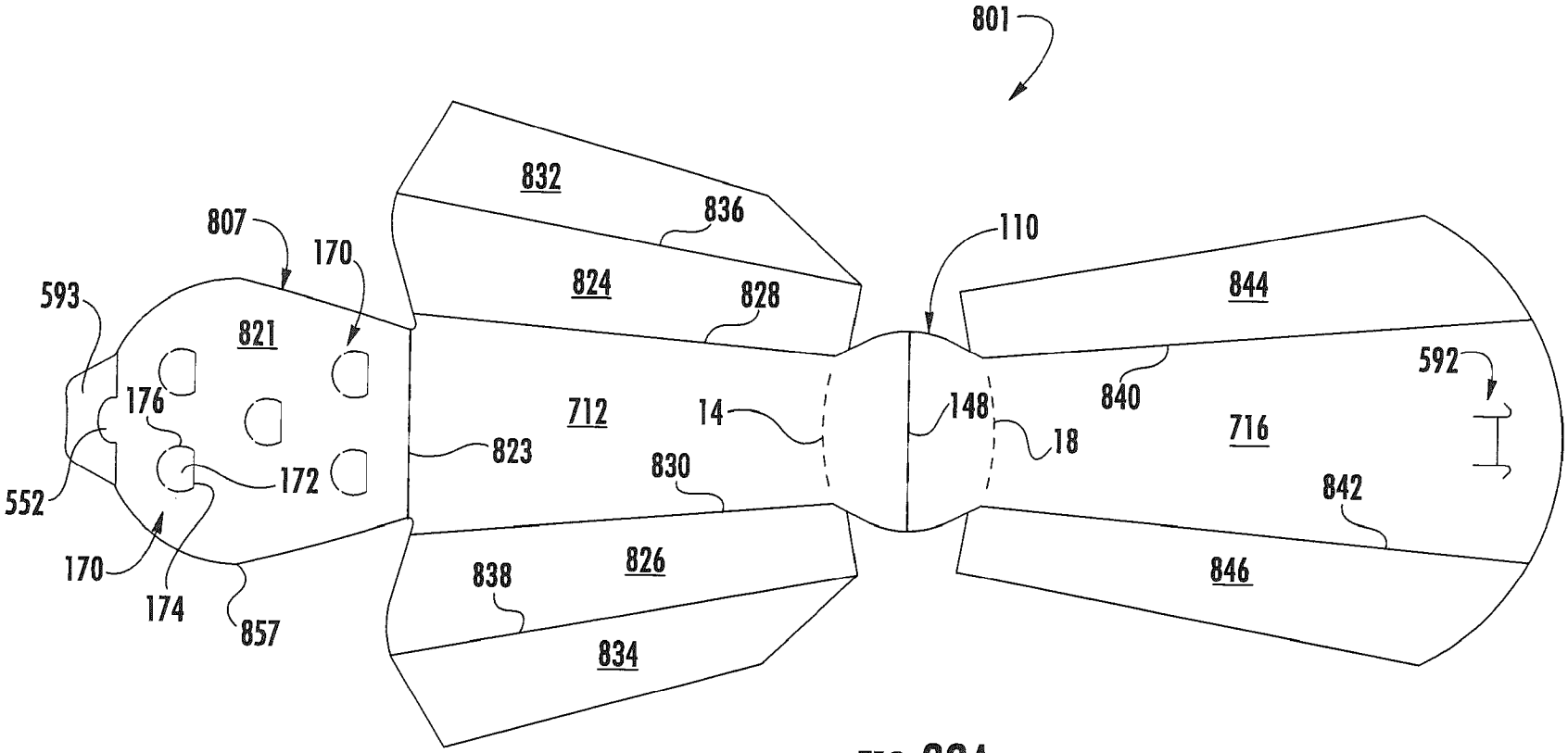
FIG. 22A is a plan view of a blank used to form a carrier according to a ninth embodiment of the disclosure.
Figure 22B:
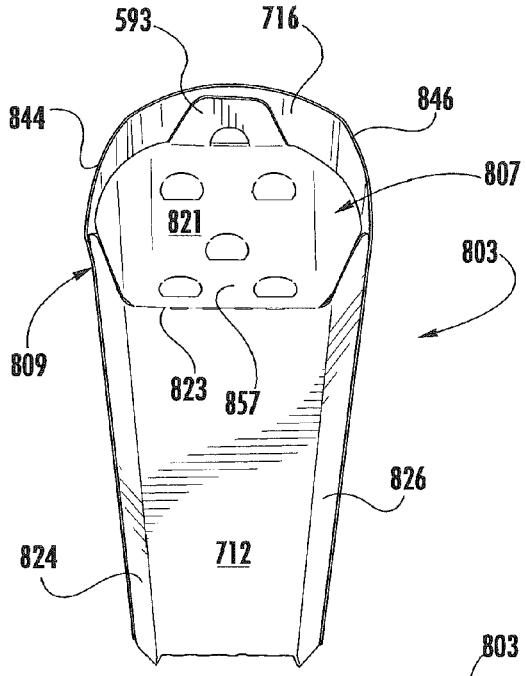
FIG. 22B is a perspective view showing the erected carrier with a closed top.
Figure 22C:
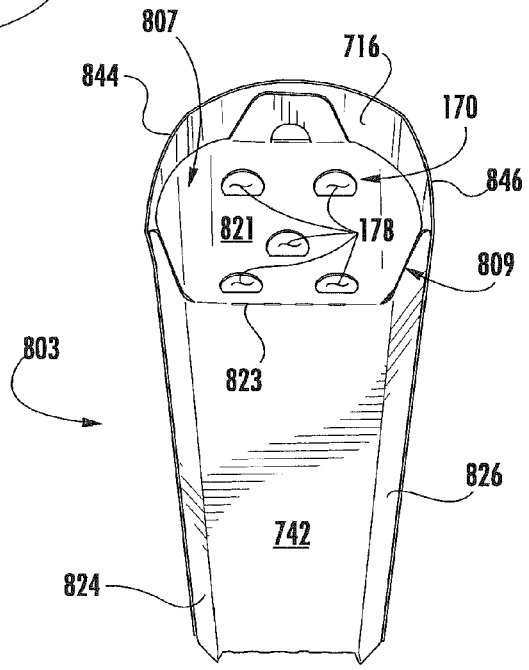
FIG. 22C is a perspective view showing the carrier of FIG. 22B with actuated vent features.
Figure 22D:
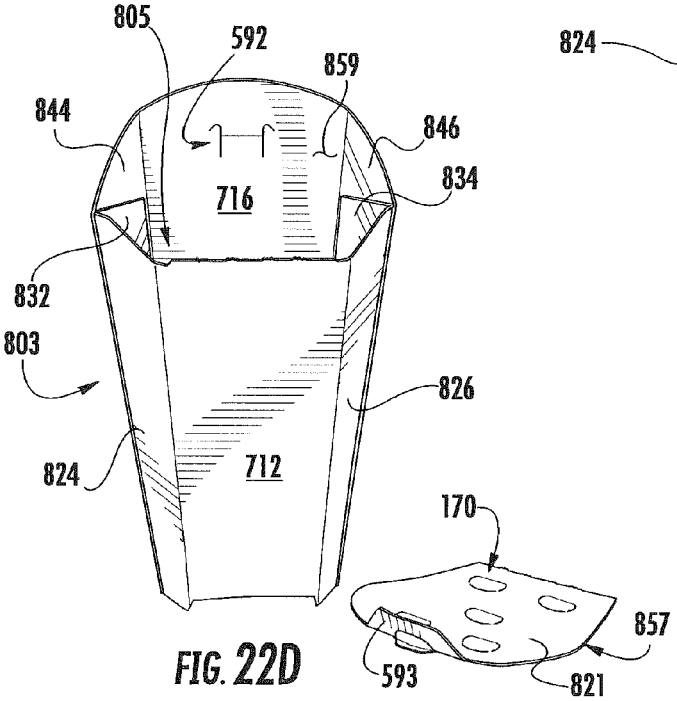
FIG. 22D is a perspective view showing the erected carrier of FIG. 22C after a dispenser is actuated.

FIG. 22A is a plan view of a blank 801 for forming a carrier 803 (FIGS. 22B-22D) according to a ninth embodiment of the disclosure. The ninth embodiment is generally similar to the eighth embodiment, except for variations noted and variations that will be apparent to one of ordinary skill in the art. Accordingly, similar or identical features of the embodiments have been given like or similar reference numbers. As shown in FIG. 22A, the blank 801 includes a top panel 821 foldably connected to the first side panel 721 along a tear line 823. The top panel 821 forms the lid 807 and the dispenser panel 857, which can be removed by tearing along the tear line 823 to form the dispenser opening 859 (FIG. 22D). The top panel 821 can include vent features 170 with vent flaps 172 foldably connected to the top panel 821 along fold lines 174 and separable from the top panel 821 along cut or tear lines 176. The vent features 170 can be actuated to form vent openings 178 as shown in FIG. 22C.

The lid 807 could be omitted or could be otherwise shaped, arranged, positioned, and/or configured without departing from the disclosure.

As shown in FIG. 22A, the blank 801 can include end panels 824, 826 foldably connected to the first side panel 712 along respective fold lines 828, 830 and end panels 844, 846 foldably connected to the second side panel 716 along respective fold lines 840, 842. Attachment flaps 832, 834 can be foldably connected to the respective end panels 824, 826 along respective fold lines 836, 838. When the carton 803 is formed, the attachment flaps 832, 834 can be adhered to the respective end panels 844, 846 to form the ends of the carton (FIGS. 22B-22C). Any of the end panels and/or attachment flaps could be omitted or could be otherwise shaped, arranged, positioned, and/or configured without departing from the disclosure. The blank 801 and the carton 803 could be otherwise shaped, arranged, and/or configured without departing from the disclosure.

Figure 23A:
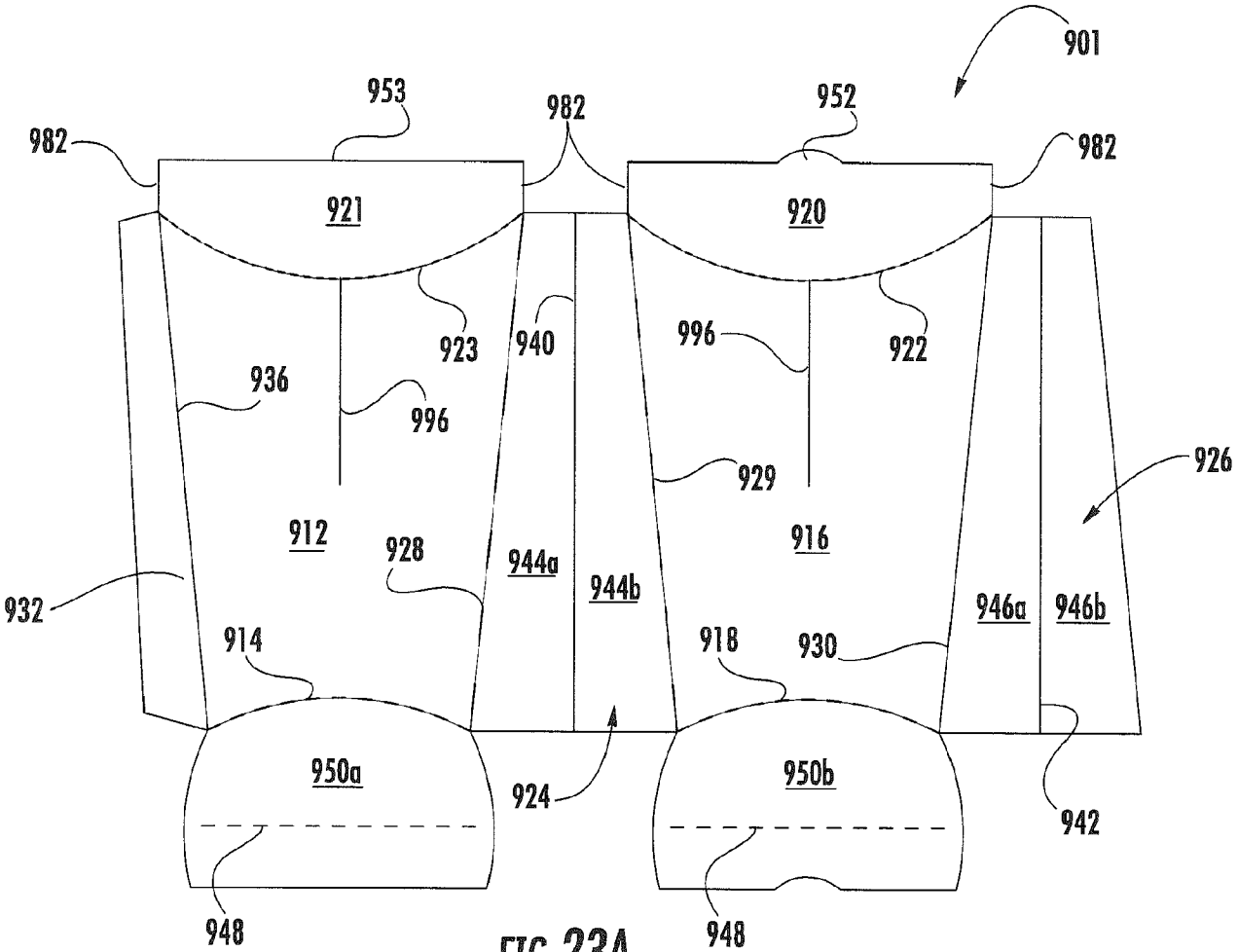
FIG. 23A is a plan view of a blank used to form a carrier according to a tenth embodiment of the disclosure.

FIG. 23A is a plan view of a blank 901 for forming a carrier 903 (FIGS. 23B-23D) according to a tenth embodiment of the disclosure. The tenth embodiment is generally similar to the third embodiment (e.g., FIGS. 16A-16D), except for variations noted and variations that will be apparent to one of ordinary skill in the art. Accordingly, similar or identical features of the embodiments have been given like or similar reference numbers. As shown in FIG. 23A, the blank 901 includes a first side panel 912 foldably connected to a first end panel 924 along a fold line 928, a second side panel 916 foldably connected to the first end panel 924 along a fold line 929, a second end panel 926 foldably connected to the second side panel 916 along a fold line 930, and an attachment flap 932 foldably connected to the first side panel 912 along a fold line 936.

In the illustrated embodiment, the side panels 912, 916 are foldably connected to respective bottom flaps 950*a*, 950*b* along respective arcuate fold lines 914, 918. Each of the bottom flaps 950*a*, 950*b* includes a respective fold line or score 948. As shown in FIG. 23A, each of the side panels 912, 916 is foldably connected to a respective top panel 921, 920 along a respective arcuate tear line 923, 922. Alternatively, the top panels could be foldably connected to the respective side panels along respective fold lines. In one embodiment, a generally vertical score line 996 can extend in each of the side panels 912, 916 from the respective tear lines 923, 922. In the illustrated embodiment, the first end panel 924 includes a first end portion 944*a* foldably connected to a second end portion 944*b* along a score or fold line 940, and the second end panel 926 includes a first end portion 946*a* foldably connected to a second end portion 946*b* along a score or fold line 942. The bottom flaps 950*a*, 950*b*, the top panels 920, 921, and/or the end panels 924, 926 could be omitted or could be otherwise shaped, arranged, positioned, and/or configured without departing from the disclosure.

In the illustrated embodiment, the carton 903 can be erected by folding the blank 901 along the fold lines and gluing the attachment flap 932 to the end portion 946*b* of the second end panel 926. The bottom flaps 950*a*, 950*b* can be overlapped and glued together to form a bottom 910 of the carton 903. In one embodiment, the fold lines 948 can be overlapped so that the carton 903 can be folded flat along at least fold lines 940, 942, 948.

Figure 23B:
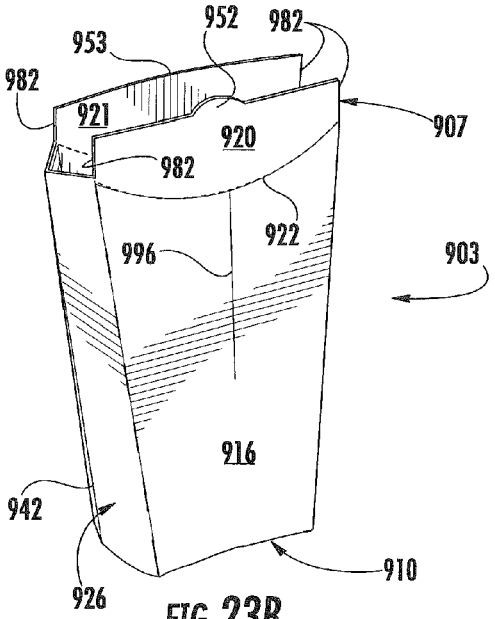
FIG. 23B is a perspective view showing the erected carrier with an open top.
Figure 23C:
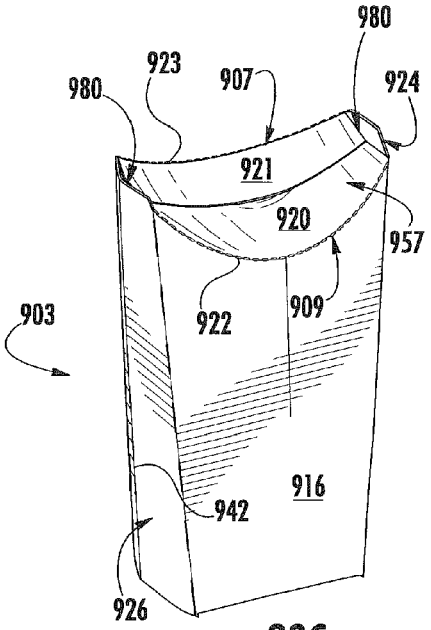
FIG. 23C is a perspective view of the carrier of FIG. 23B with a closed top.
Figure 23D:
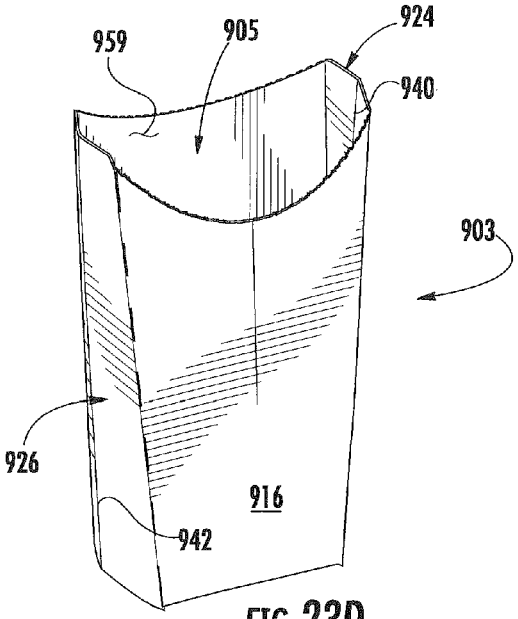
FIG. 23D is a perspective view of the carrier of FIG. 23C after a dispenser is actuated.

As shown in FIGS. 23B and 23C, the top panels 920, 921 cooperate to form an integrated lid 907 with closure features. The closure features can include a closure tab 952 extending from the first top panel 920 and an edge 953 of the second top panel 921. Accordingly, the lid 907 can be closed by tucking the closure tab 952 at least partially under the edge 953 of the second top panel 921 (FIG. 23C). In the illustrated embodiment, when integrated lid 907 is closed (FIG. 23C), upper vent features 980 can be formed between the end panels 924, 926 and the edges 982 (FIG. 23B) of the top panels 920, 921. In one embodiment, the top panels 920, 921 can cooperate to form a dispenser panel 957 of a dispenser 909. As shown in FIG. 23D, the dispenser panel 957 can be torn away from the carton 903 along the tear lines 922, 923 to form a dispenser opening 952 in the carton and provide access to articles in the interior 905 of the carton. The blank 901 and the carton 903 could be otherwise shaped, arranged, and/or configured without departing from the disclosure.

Figure 24A:
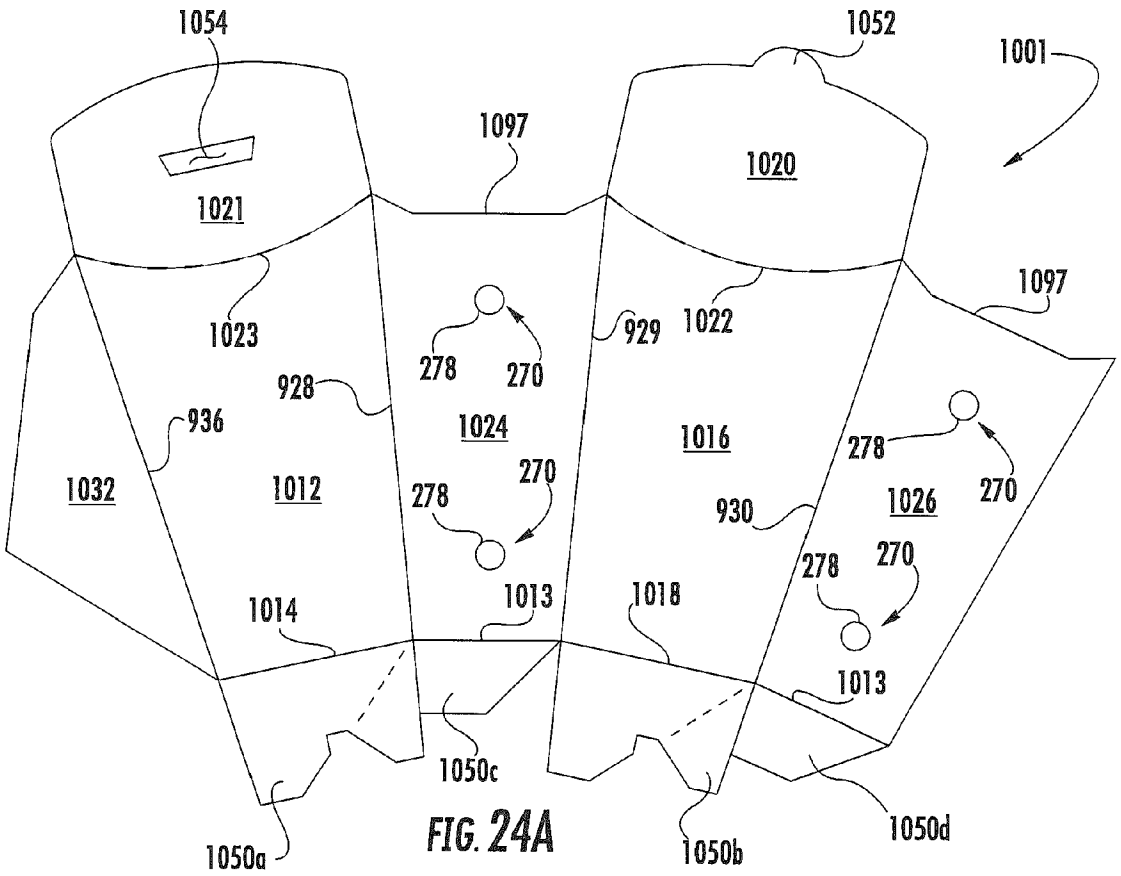
FIG. 24A is a plan view of a blank used to form a carrier according to an eleventh embodiment of the disclosure.

FIG. 24A is a plan view of a blank 1001 for forming a carrier 1003 (FIGS. 24B-24D) according to an eleventh embodiment of the disclosure. The eleventh embodiment is generally similar to the tenth embodiment, except for variations noted and variations that will be apparent to one of ordinary skill in the art. Accordingly, similar or identical features of the embodiments have been given like or similar reference numbers. As shown in FIG. 24A, the blank 1001 includes end panels 1024, 1026 foldably connected to the side panels 1012, 1016 and an attachment flap 1032 foldably connected to the side panel 1012. The attachment flap 1032 can have a different shape than the attachment flap 932 of FIG. 23A, and the end panels 1024, 1026 do not include the fold lines 940, 942 of the tenth embodiment. The side panels 1012, 1016 can be foldably connected to bottom panels 1050*a*, 1050*b* along respective fold lines 1014, 1018, and the end panels 1024, 1026 can be foldably connected to respective bottom flaps 1050*c*, 1050*d* along respective fold lines 1013. The bottom panels 1050*a*, 1050*b* and the bottom flaps 1050*c*, 1050*d* can be overlapped and/or interlocked and/or glued together to form a bottom (not shown) of the carton 1003. Any of the side panels, the end panels, the attachment flap, the bottom panels, and/or the bottom flaps could be omitted or could be otherwise shaped, arranged, positioned, and/or configured without departing from the disclosure.

Figure 24B:
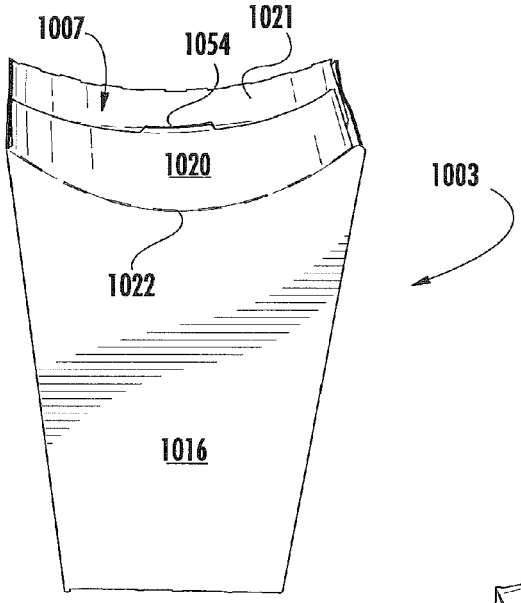
FIGS. 24B and 24C are perspective views showing the erected carrier with a closed top.
Figure 24C:
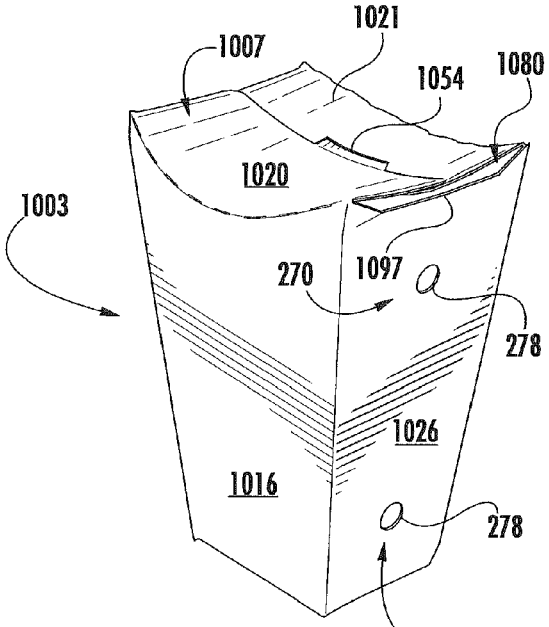
Figure 24D:
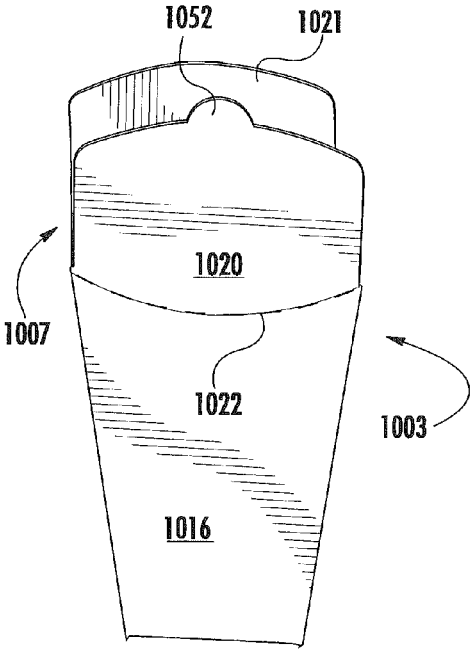
FIG. 24D is a perspective view of the carrier of FIGS. 24B and 24C with an open top.

In the illustrated embodiment, top panels 1020, 1021, foldably connected to the respective side panels 1016, 1012 along respective arcuate fold lines 1022, 1023, cooperate to form an integrated lid 1007 (FIGS. 24B and 24D). Closure features of the lid 1007 include a closure tab 1052 and a closure slot 1054. The upper edges 1097 of the end panels 1024, 1026 can be recessed or notched so that, when the lid 1007 is closed (FIGS. 24B and 24C), the upper edges 1097 are spaced apart from the overlapped top panels 1020, 1021 to form upper vent features 1080 (FIG. 24C). As shown in FIGS. 24A and 24C, the end panels 1024, 1026 can include vent features 270 including vent openings 278. Any of the top panels and/or the vent features could be omitted or could be otherwise shaped, arranged, positioned, and/or configured without departing from the disclosure. The blank 1001 and the carton 1003 could be otherwise shaped, arranged, and/or configured without departing from the disclosure.

Figure 25A:
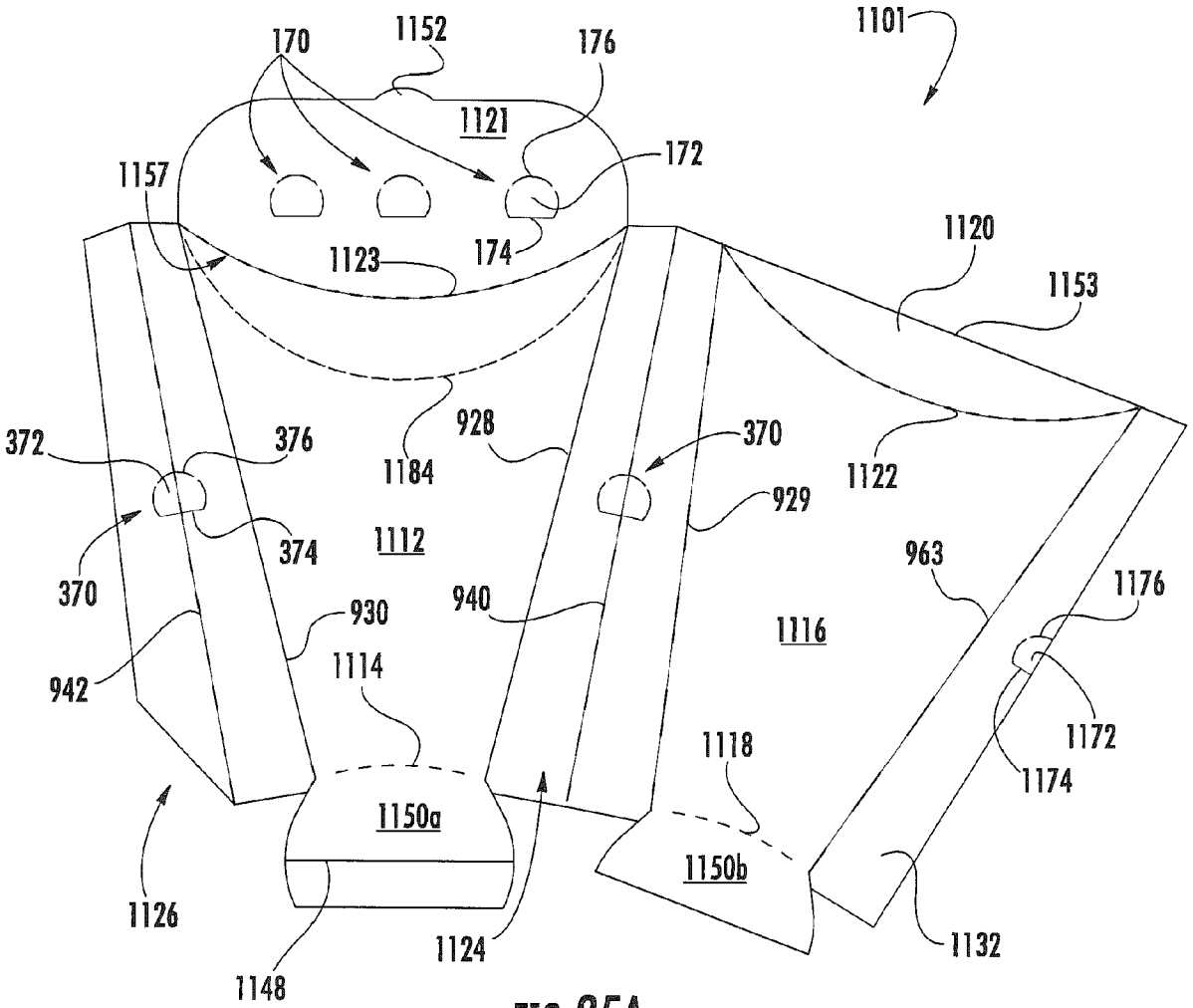
FIG. 25A is a plan view of a blank used to form a carrier according to a twelfth embodiment of the disclosure.

FIG. 25A is a plan view of a blank 1101 for forming a carrier 1103 (FIGS. 25B-25D) according to a twelfth embodiment of the disclosure. The twelfth embodiment is generally similar to the tenth embodiment, except for variations noted and variations that will be apparent to one of ordinary skill in the art. Accordingly, similar or identical features of the embodiments have been given like or similar reference numbers. As shown in FIG. 25A, the blank 1101 includes vent features 170 as described above with respect to FIG. 8 in the second top panel 1121 and vent features 370 as described above with respect to FIG. 17A in the end panels 1124, 1126. In addition, a partial vent flap 1170 is foldably connected to the attachment flap 1132 along a fold line 1174. The partial vent flap 1172 is separable from the attachment flap 1132 along a cut or tear line 1176. When the carton 1103 is formed, the attachment flap 1132 is glued to the end panel 1126, and the vent flap 372 can at least partially overlap the partial vent flap 1172 (FIG. 25C). The vent features could be omitted or could be otherwise shaped, arranged, positioned, and/or configured without departing from the disclosure.

Figure 25B:
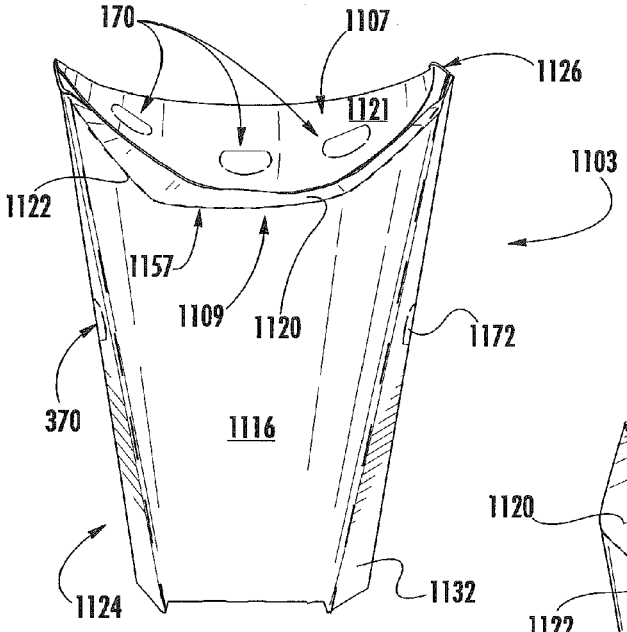
FIGS. 25B and 25C are perspective views showing the erected carrier with a closed top.
Figure 25C:
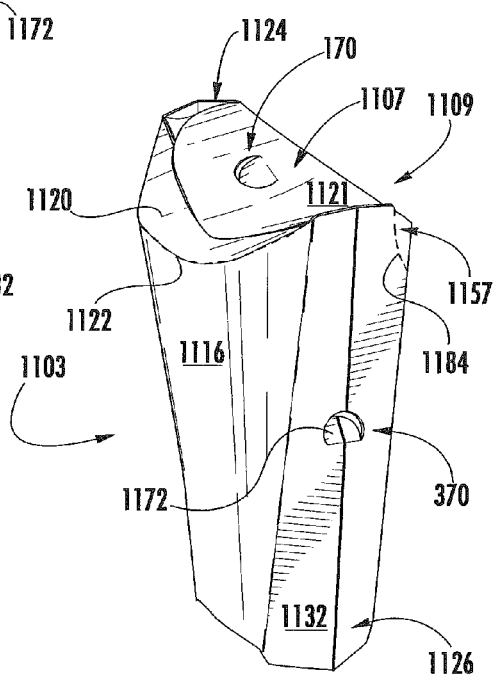
Figure 25D:
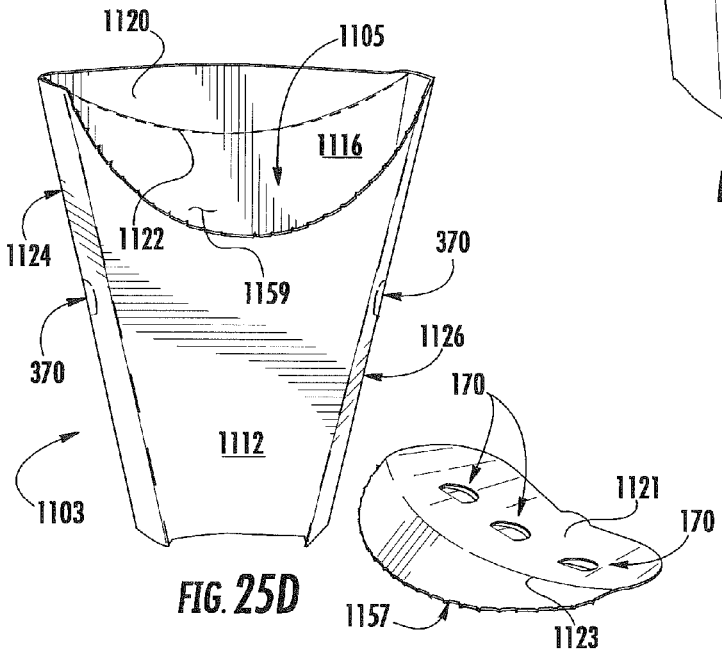
FIG. 25D is a perspective view of the carrier of FIGS. 25B and 25C after a dispenser is actuated.

As shown in FIGS. 25B and 25C, the top panels 1120, 1121 cooperate to form an integrated lid 1107 with a closure tab 1152 extending from the first top panel 1120 engaging an edge 1153 of the second top panel 1021. In the illustrated embodiment, the carton 1103 can include a dispenser 1109 with a dispenser panel 1157 (FIGS. 25B-25C) defined by an arcuate tear line 1184 in the first side panel 1112. Accordingly, the dispenser panel 1157 includes the second top panel 1121 and an upper portion of the second side panel 1112. The dispenser panel 1157 can be torn away from the remainder of the carton 1103 by tearing along the tear line 1184 to form a dispenser opening 1159 to provide access to articles in the interior 1105 of the container 1103. The lid 1107 and/or the dispenser 1109 could be omitted or could be otherwise shaped, arranged, positioned, and/or configured without departing from the disclosure. The blank 1101 and the carton 1103 could be otherwise shaped, arranged, and/or configured without departing from the disclosure.

Figure 26A:
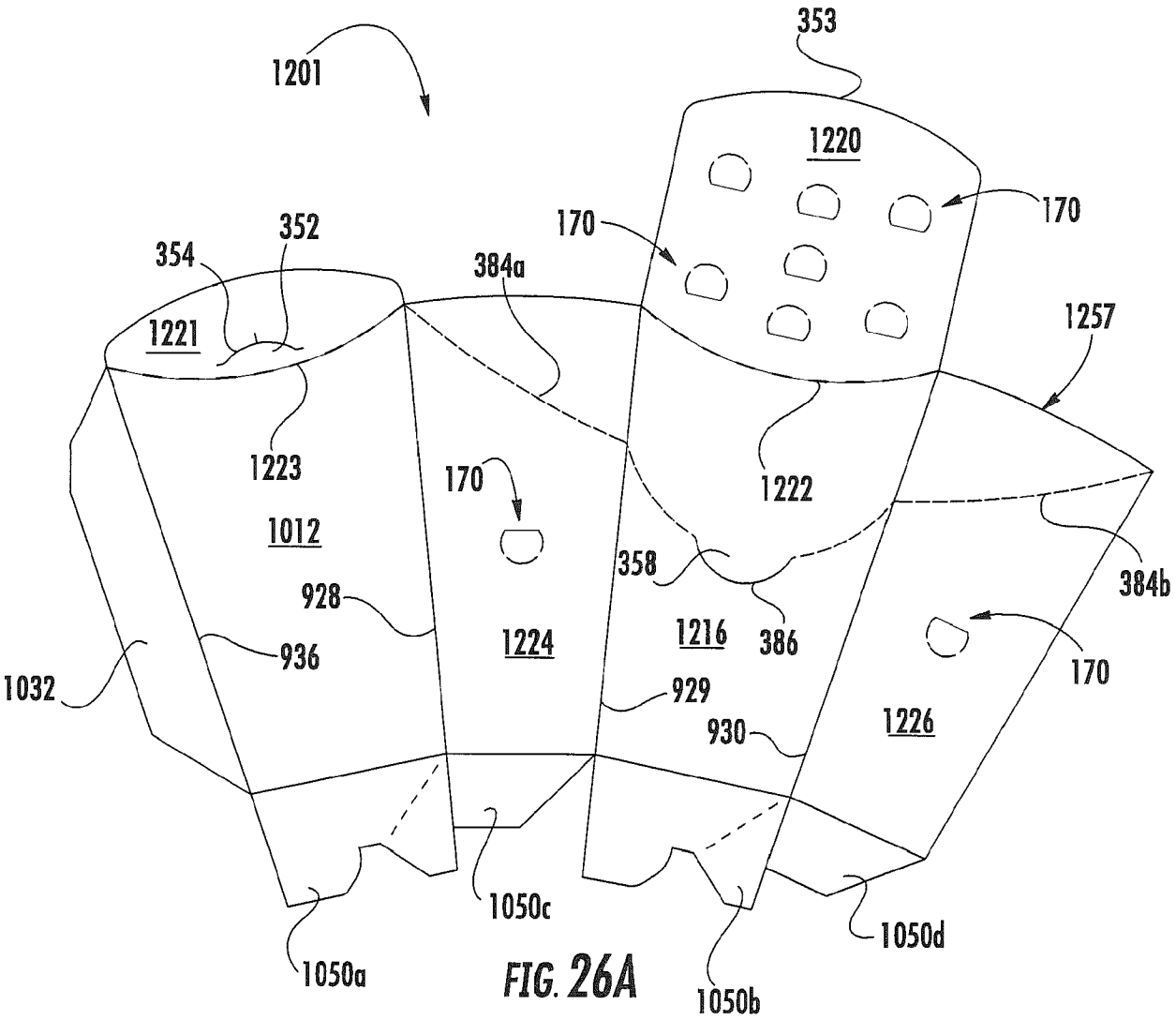
FIG. 26A is a plan view of a blank used to form a carrier according to a thirteenth embodiment of the disclosure.
Figure 26B:
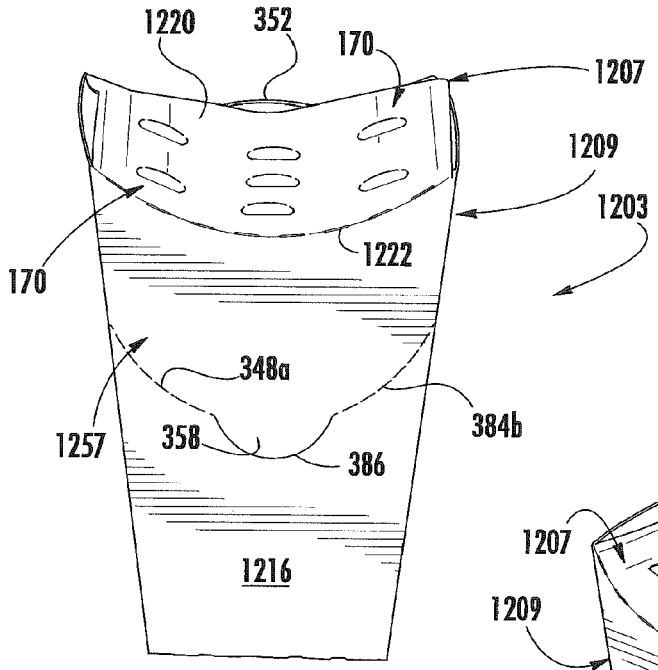
FIGS. 26B and 26C are perspective views showing the erected carrier with a closed top.
Figure 26C:
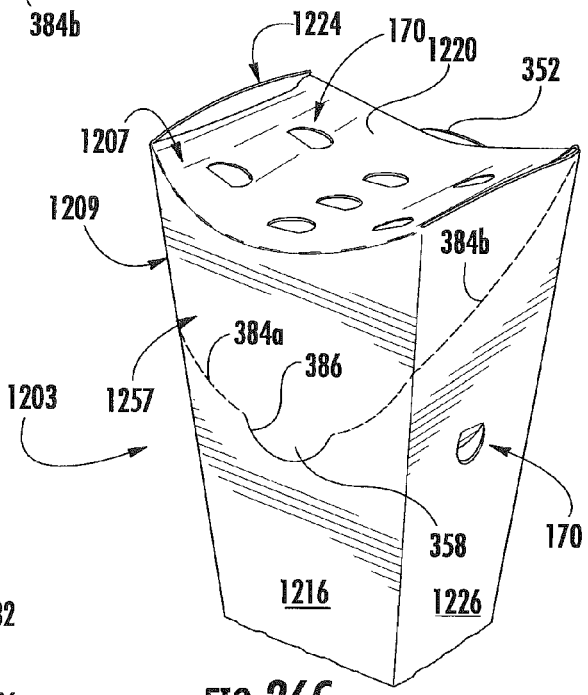
Figure 26D:
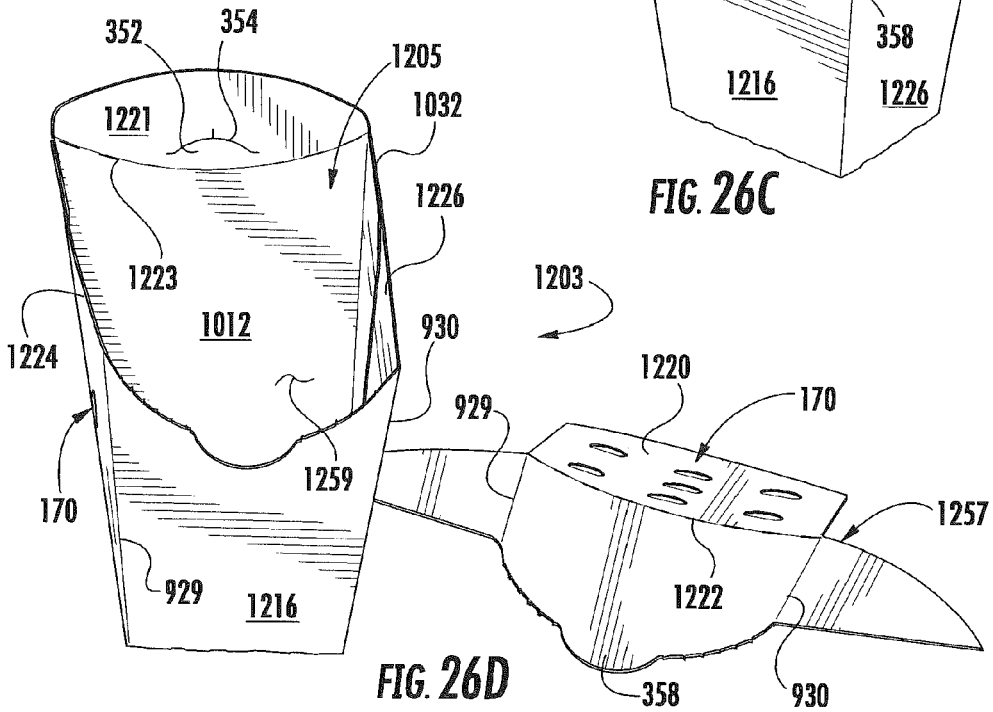
FIG. 26D is a perspective view of the carrier of FIGS. 26B and 26C after a dispenser is actuated.

FIG. 26A is a plan view of a blank 1201 for forming a carrier 1203 (FIGS. 26B-26D) according to a thirteenth embodiment of the disclosure. The thirteenth embodiment is generally similar to the eleventh embodiment (e.g., FIGS. 24A-24D), except for variations noted and variations that will be apparent to one of ordinary skill in the art. Accordingly, similar or identical features of the embodiments have been given like or similar reference numbers. As shown in FIG. 26A, the blank 1201 includes top panels 1220, 1221 that cooperate to form an integrated lid 1207 (FIGS. 26B and 26C). A dispenser 1209 (FIGS. 26B and 26C) includes a dispenser panel 1257 defined by tear lines 384*a*, 384*c* and an access feature 358 in the second side panel 1216 and the end panels 1224, 1226. The dispenser 1209 can be similar to the dispenser 309 described with respect to FIGS. 17A-17D above. In one embodiment, vent features 170 can be included in the first top panel 1220 and the end panels 1224, 1226. The dispenser panel 1257 can be removed to form a dispenser opening 1259 in the carton 1203 by tearing along the tear lines 384*a*, 384*b* (FIG. 26D). The blank 1201 and the carton 1203 could be otherwise shaped, arranged, and/or configured without departing from the disclosure.

Any of the features of the various embodiments of the disclosure can be combined with, replaced by, or otherwise configured with other features of other embodiments of the disclosure without departing from the scope of this disclosure. For example, any of the embodiments could be configured for being hand formed (e.g., initially folded flat during or after gluing and then expanded for filling at a point of use), machine formed (e.g., erected and glued by a machine in an expanded configuration, ready for filling), or both.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blanks. In accordance with the above-described embodiments, the blank may be constructed of paperboard of a caliper such that it is heavier and more rigid than ordinary paper. The blanks can also be constructed of other materials, such as cardboard, hard paper, or any other material having properties suitable for enabling the cartons, to function at least generally as described above. The blanks can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the spaced apart slits to be replaced with a continuous slit, a continuous score, or the like. For example, a cut line can be a continuous slit or could be wider than a slit without departing from the present disclosure. Also, a tear line can be a series of cut scores passing completely, or partially, through the material, that are separated by nicks.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a cooked food product, the carton comprising:

a plurality of panels that extend at least partially around an interior of the carton, the plurality of panels comprising a bottom panel, a first side panel, a second side panel, a top panel, and an end panel;

a lid positionable to at least partially close a top of the carton, the lid comprises the top panel that is foldably connected to the first side panel, a first closure feature in the top panel and a second closure feature in the second side panel;

the end panel is foldably connected to at least one of the first side panel and the second side panel and comprises a curved free edge; and at least one vent feature in at least one panel of the plurality of panels for at least partially maintaining product attributes of the cooked food product contained in the carton by at least partially venting the carton;

wherein the top panel extends from the first side panel to the second side panel and conforms to the curved free edge of the end panel, the at least one vent feature comprises a first vent flap and a second vent flap, the first vent flap being foldably connected to the lid along a first fold line and positionable between a closed position closing the interior and an actuated position accessing the interior of the carton, and the second vent flap being foldably connected to the end panel along a second fold line and positionable between a closed position and an actuated position.

2. The carton of claim 1, wherein the first vent flap is separable from the lid along a tear line.

3. The carton of claim 1, wherein the at least one vent feature comprises a plurality of vent flaps foldably connected to the lid along respective fold lines, and each vent flap of the plurality of vent flaps is positionable between a closed position and an actuated position.

4. The carton of claim 1, wherein the at least one vent feature comprises a vent opening at least partially defined between the end panel and an edge of the lid.

5. The carton of claim 4, wherein the end panel comprises a first end portion foldably connected to a second end portion along a third fold line, the third fold line is spaced apart from an edge of the lid, and the vent opening is at least partially defined between the edge of the lid and the third fold line.

6. The carton of claim 1, wherein the first closure feature comprises a closure tab extending from the top panel, and the second closure feature comprises a closure slot formed in the second side panel for at least partially receiving the closure tab, the closure slot being spaced apart from an upper edge of the second side panel.

7. The carton of claim 1, wherein the first closure feature comprises a closure tab extending in the top panel and a closure flap foldably connected to the top panel, the closure tab being at least partially defined by a cut line in the closure flap.

8. The carton of claim 1, wherein the top panel is foldably connected to the first side panel along a tear line, the top panel being separable from the first side panel along the tear line to at least partially form a dispenser opening in the carton.

9. The carton of claim 8, wherein the top panel is a first top panel, the tear-line is a first tear line, and the lid further comprises a second top panel foldably connected to the second side panel along a second tear line, the second top panel being separable from the second side panel along the second tear line to at least partially form the dispenser opening in the carton.

10. The carton of claim 1, further comprising a dispenser comprising a dispenser panel at least partially defined by a tear line extending in at least one panel of the plurality of panels, the dispenser panel being at least partially separable along the tear line to at least partially form a dispenser opening in the carton.

11. The carton of claim 10, wherein the dispenser panel comprises at least a portion of the lid and the first side panel, the tear line extending at least partially across the first side panel and being at least partially spaced apart from the lid.

12. The carton of claim 11, wherein the tear line extends from the first side panel to an edge of the end panel.

13. The carton of claim 12, wherein the end panel is a first end panel and the tear line is a first tear line, the carton further comprises a second end panel foldably connected to at least the first side panel, and the dispenser panel is at least partially defined by a second tear line extending in the first side panel and the second end panel to an edge of the second end panel.

14. The carton of claim 13, wherein the dispenser panel is a first dispenser panel, the first dispenser panel is further defined by a third tear line in the first side panel extending from an end of the first tear line to an end of the second tear line, and the dispenser further comprises a second dispenser panel at least partially defined by the third tear line and a fourth tear line extending in at least the first side panel, the second dispenser panel being at least partially separable along the fourth tear line to extend the dispenser opening in the first side panel.

15. A carton for containing a cooked food product, the carton comprising:

a plurality of panels that extend at least partially around an interior of the carton, the plurality of panels comprising a bottom panel, a first side panel, a second side panel, a top panel, and an end panel;

a lid positionable to at least partially close a top of the carton, the lid comprises the top panel that is foldably connected to the first side panel, a first closure feature in the top panel and a second closure feature in the second side panel;

the end panel is foldably connected to at least one of the first side panel and the second side panel and comprises a curved free edge; and at least one vent feature in at least one panel of the plurality of panels for at least partially maintaining product attributes of the cooked food product contained in the carton by at least partially venting the carton;

wherein the top panel extends from the first side panel to the second side panel and conforms to the curved free edge of the end panel, the at least one vent feature comprises a vent flap foldably connected to the lid along a fold line and positionable between a closed position closing the interior and an actuated position accessing the interior of the carton, and the at least one vent feature comprises a first vent opening defined in the end panel and allowing access to the interior of the carton and a second vent opening defined in the end panel.

16. A carton for containing a cooked food product, the carton comprising:

a plurality of panels that extend at least partially around an interior of the carton, the plurality of panels comprising a bottom panel, a first side panel, a second side panel, a top panel, and an end panel;

a lid positionable to at least partially close a top of the carton, the lid comprises the top panel that is foldably connected to the first side panel, a first closure feature in the top panel and a second closure feature in the second side panel;

the end panel is foldably connected to at least one of the first side panel and the second side panel and comprises a curved free edge; and at least one vent feature in at least one panel of the plurality of panels for at least partially maintaining product attributes of the cooked food product contained in the carton by at least partially venting the carton;

wherein the top panel extends from the first side panel to the second side panel and conforms to the curved free edge of the end panel, the at least one vent feature comprises a vent flap foldably connected to the lid along a fold line and positionable between a closed position closing the interior and an actuated position accessing the interior of the carton, the first closure feature comprises a closure tab extending from the top panel, and the second closure feature comprises a closure flap at least partially defined by a cut line in the second side panel, the closure flap being foldable with respect to the second side panel for forming a closure opening in the second side panel for at least partially receiving the closure tab.

17. A blank for forming a carton for containing a cooked food product, the blank comprising:

a plurality of panels comprising a bottom panel, a first side panel, a second side panel, a top panel, and an end panel;

a lid positionable to at least partially close a top of the carton formed from the blank, the lid comprises the top panel that is foldably connected to the first side panel, a first closure feature in the top panel and a second closure feature in the second side panel;

the end panel is foldably connected to at least one of the first side panel and the second side panel, the end panel comprises a curved free edge; and at least one vent feature in at least one panel of the plurality of panels for at least partially maintaining product attributes of the cooked food product contained in the carton formed by the blank by at least partially venting the carton formed from the blank;

wherein the top panel is configured to extend from the first side panel to the second side panel in the carton formed from the blank, the lid is configured to conform to the curved free edge of the end panel in the carton formed by the blank, the at least one vent feature comprises a first vent flap and a second vent flap, the first vent flap being foldably connected to the lid along a first fold line and positionable between a closed position closing an interior of the carton and an actuated position accessing the interior of the carton when the carton is formed from the blank, and the second vent flap being foldably connected to the end panel along a second fold line and positionable between a closed position and an actuated position.

18. The blank of claim 17, wherein the first vent flap is separable from the lid along a tear line.

19. The blank of claim 17, wherein the at least one vent feature comprises a plurality of vent flaps foldably connected to the lid along respective fold lines, and each vent flap of the plurality of vent flaps is positionable between a closed position and an actuated position.

20. The blank of claim 17, wherein the at least one vent feature comprises a vent opening for being at least partially defined between the end panel and an edge of the lid when the carton is formed from the blank.

21. The blank of claim 20, wherein the end panel comprises a first end portion foldably connected to a second end portion along a third fold line, the third fold line is for being spaced apart from the edge of the lid when the carton is formed from the blank, and the vent opening is for being at least partially defined between the edge of the lid and the third fold line when the carton is formed from the blank.

22. The blank of claim 17, wherein the first closure feature comprises a closure tab extending from the top panel, and the second closure feature comprises a closure slot formed in the second side panel for at least partially receiving the closure tab when the carton is formed from the blank, the closure slot being spaced apart from an upper edge of the second side panel.

23. The blank of claim 17, wherein the first closure feature comprises a closure tab extending in the top panel and a closure flap foldably connected to the top panel, the closure tab being at least partially defined by a cut line in the closure flap.

24. The blank of claim 17, wherein the top panel is foldably connected to the first side panel along a tear line, the top panel being separable from the first side panel along the tear line for at least partially forming a dispenser opening in the carton formed from the blank.

25. The blank of claim 24, wherein the top panel is a first top panel, the tear line is a first tear line, and the lid further comprises a second top panel foldably connected to the second side panel along a second tear line, the second top panel being separable from the second side panel along the second tear line for at least partially forming the dispenser opening in the carton formed from the blank.

26. The blank of claim 17, further comprising dispenser features for forming a dispenser in the carton formed from the blank, the dispenser features comprising a dispenser panel at least partially defined by a tear line extending in at least one panel of the plurality of panels, the dispenser panel being at least partially separable along the tear line for at least partially forming a dispenser opening in the carton formed from the blank.

27. The blank of claim 26, wherein the dispenser panel comprises at least a portion of the lid and the first side panel, the tear line extending at least partially across the first side panel and being at least partially spaced apart from the lid.

28. The blank of claim 27, further comprising an end panel foldably connected to at least the first side panel, wherein the tear line extends from the first side panel to an edge of the end panel.

29. The blank of claim 28, wherein the end panel is a first end panel and the tear line is a first tear line, the blank further comprises a second end panel foldably connected to at least the first side panel, and the dispenser panel is at least partially defined by a second tear line extending in the first side panel and the second end panel to an edge of the second end panel.

30. The blank of claim 29, wherein the dispenser panel is a first dispenser panel, the first dispenser panel is further defined by a third tear line in the first side panel extending from an end of the first tear line to an end of the second tear line, and the dispenser features further comprise a second dispenser panel at least partially defined by the third tear line and a fourth tear line extending in at least the first side panel, the second dispenser panel being at least partially separable along the fourth tear line to extend the dispenser opening in the first side panel.

31. A blank for forming a carton for containing a cooked food product, the blank comprising:

a plurality of panels comprising a bottom panel, a first side panel, a second side panel, a top panel, and an end panel;

a lid positionable to at least partially close a top of the carton formed from the blank, the lid comprises the top panel that is foldably connected to the first side panel, a first closure feature in the top panel and a second closure feature in the second side panel;

the end panel is foldably connected to at least one of the first side panel and the second side panel, the end panel comprises a curved free edge; and at least one vent feature in at least one panel of the plurality of panels for at least partially maintaining product attributes of the cooked food product contained in the carton formed by the blank by at least partially venting the carton formed from the blank;

wherein the top panel is configured to extend from the first side panel to the second side panel in the carton formed from the blank, the lid is configured to conform to the curved free edge of the end panel in the carton formed by the blank, the at least one vent feature comprises a vent flap foldably connected to the lid along a fold line, the vent flap is positionable between a closed position closing an interior of the carton and an actuated position accessing the interior of the carton when the carton is formed from the blank, and the at least one vent feature comprises a first vent opening defined in the end panel and a second vent opening defined in the end panel.

32. A blank for forming a carton for containing a cooked food product, the blank comprising:

a plurality of panels comprising a bottom panel, a first side panel, a second side panel, a top panel, and an end panel;

a lid positionable to at least partially close a top of the carton formed from the blank, the lid comprises the top panel that is foldably connected to the first side panel, a first closure feature in the top panel and a second closure feature in the second side panel;

the end panel is foldably connected to at least one of the first side panel and the second side panel, the end panel comprises a curved free edge; and at least one vent feature in at least one panel of the plurality of panels for at least partially maintaining product attributes of the cooked food product contained in the carton formed by the blank by at least partially venting the carton formed from the blank;

wherein the top panel is configured to extend from the first side panel to the second side panel in the carton formed from the blank, the lid is configured to conform to the curved free edge of the end panel in the carton formed by the blank, the at least one vent feature comprises a vent flap foldably connected to the lid along a fold line, the vent flap is positionable between a closed position closing an interior of the carton and an actuated position accessing the interior of the carton when the carton is formed from the blank, the first closure feature comprises a closure tab extending from the top panel, and the second closure feature comprises a closure flap at least partially defined by a cut line in the second side panel, the closure flap being foldable with respect to the second side panel for forming a closure opening in the second side panel for at least partially receiving the closure tab when the carton is formed from the blank.

33. A method of forming a carton for containing a cooked food product, the method comprising:

obtaining a blank comprising a plurality of panels comprising a bottom panel, a first side panel, a second side panel, a top panel foldably connected to the first side panel, a first end panel foldably connected to at least one of the first side panel and the second side panel, a second end panel foldably connected to at least one of the first side panel and the second side panel, a first attachment flap, and a second attachment flap, wherein the first end panel comprises a first curved free edge and the second end panel comprises a second curved free edge, the blank comprises a lid and at least one vent feature in at least one panel of the plurality of panels, the at least one vent feature comprises a first vent flap and a second vent flap, the first vent flap being foldably connected to the lid along a first fold line and positionable between a closed position closing the interior and an actuated position accessing the interior of the carton, the second vent flap being foldably connected to the end panel along a second fold line and positionable between a closed position and an actuated position, and the forming the interior of the carton comprises positioning the second side panel to be generally opposite to the first side panel, folding the first end panel and the second end panel relative to the first side panel toward the second side panel, and attaching each of the first attachment flap and the second attachment flap in face-to-face contact with the second side panel; and forming an interior of the carton at least partially defined by the plurality of panels comprising positioning the second side panel to be generally opposite to the first side panel, folding the first end panel and the second end panel relative to the first side panel toward the second side panel, and attaching each of the first attachment flap and the second attachment flap in face-to-face contact with the second side panel;

positioning the lid to at least partially close a top of the carton, the lid comprises the top panel that is foldably connected to the first side panel, a first closure feature in the top panel, and a second closure feature in the second side panel, the positioning comprises positioning the top panel to extend from the first side panel to the second side panel and conforming the top panel to at least one of the first curved edge and the second curved edge, wherein the at least one vent feature is for at least partially maintaining product attributes of the cooked food product contained in the carton by at least partially venting the carton.

34. The method of claim 33, wherein the at least one vent feature comprises a vent flap foldably connected to at least one of the first end panel and the second end panel along a fold line, and the method further comprises actuating at least one vent feature of the plurality of vent features by folding the vent flap from a closed position to an actuated position.

35. The method of claim 33, wherein the positioning the lid comprises closing the lid by folding the top panel relative to the first side panel.

36. The method of claim 35, wherein the closing the lid further comprises engaging the first closure feature with the second closure feature.

37. The method of claim 35, wherein the top panel is a first top panel, the plurality of panels comprises a second top panel foldably connected to the second side panel, and the closing the lid further comprises folding the second top panel relative to the second side panel.

38. The method of claim 37, wherein the lid comprises a first closure feature in the first top panel and a second closure feature in the second top panel, and the closing the lid further comprises engaging the first closure feature with the second closure feature.

39. The method of claim 33, wherein the blank further comprises dispenser features comprising a dispenser panel at least partially defined by a tear line extending in the blank, and the method further comprises forming a dispenser from the dispenser features.

* * * * *